US009120302B2

(12) United States Patent
Rossini

(10) Patent No.: US 9,120,302 B2
(45) **Date of Patent: *Sep. 1, 2015**

(54) BRIDGE SLEEVES WITH DIAMETRICALLY EXPANDABLE STABILIZERS

(71) Applicant: ROSSINI S.P.A., Rescaldina, Milan (IT)

(72) Inventor: Felice Rossini, Rescaldina (IT)

(73) Assignee: ROSSINI S.P.A., Milan (IT)

( * ) Notice: Subject to any disclaimer, the term of this patent is extended or adjusted under 35 U.S.C. 154(b) by 150 days.

This patent is subject to a terminal disclaimer.

(21) Appl. No.: 13/835,654

(22) Filed: Mar. 15, 2013

(65) Prior Publication Data

US 2013/0284038 A1 Oct. 31, 2013

Related U.S. Application Data

(63) Continuation-in-part of application No. 13/753,622, filed on Jan. 30, 2013.

(60) Provisional application No. 61/640,277, filed on Apr. 30, 2012, provisional application No. 61/678,867, filed on Aug. 2, 2012, provisional application No. 61/757,440, filed on Jan. 28, 2013.

(51) Int. Cl.
*B41F 27/06* (2006.01)
*B41F 27/10* (2006.01)

(52) U.S. Cl.
CPC ..... *B41F 27/06* (2013.01); *B41F 27/105* (2013.01); *B41P 2227/20* (2013.01)

(58) Field of Classification Search
CPC ..... B41F 13/08; B41F 13/10; B41F 27/06; B41F 27/14; B41F 27/105; B41F 27/1212; B41N 6/00; B41P 2227/20; B41P 2227/21
See application file for complete search history.

(56) References Cited

U.S. PATENT DOCUMENTS

| | | | | |
|---|---|---|---|---|
| 4,028,783 | A | 6/1977 | Buck | |
| 4,360,208 | A | 11/1982 | Hill et al. | |
| 4,583,460 | A | 4/1986 | Maslin et al. | |
| 5,036,766 | A | 8/1991 | Songer | |
| 5,499,780 | A | 3/1996 | Gensheimer | |
| 5,735,206 | A | 4/1998 | Rossini | |
| 5,782,181 | A | 7/1998 | Rossini | |
| 5,819,657 | A | 10/1998 | Rossini | |
| 5,840,386 | A | 11/1998 | Hatch et al. | |
| 5,904,095 | A | 5/1999 | Nelson | |
| 6,149,364 | A * | 11/2000 | Maeda | 411/432 |

(Continued)

FOREIGN PATENT DOCUMENTS

| | | |
|---|---|---|
| BE | 410680 | 9/1935 |
| DE | 19940109 | 3/2001 |

(Continued)

OTHER PUBLICATIONS

International Search Report and Written Opinion for PCT/EP2013/058971, Oct. 11, 2013.

*Primary Examiner* — Blake A Tankersley
(74) *Attorney, Agent, or Firm* — Dority & Manning, P.A.

(57) ABSTRACT

A bridge sleeve has at each extreme end of the bridge sleeve, a multi-component stabilizer. One component of each stabilizer includes an inner cylindrical contacting surface having a diameter that changes as this respective component of the stabilizer moves axially relative to at least one other component of the respective stabilizer.

13 Claims, 28 Drawing Sheets

(56) References Cited

U.S. PATENT DOCUMENTS

| | | | |
|---|---|---|---|
| 6,276,271 | B1 | 8/2001 | Busshoff |
| 6,360,662 | B1 | 3/2002 | Busshoff |
| 6,401,613 | B1 | 6/2002 | Gayle et al. |
| 6,401,615 | B1 | 6/2002 | Heinicke |
| 6,467,409 | B2 | 10/2002 | Busshoff |
| 6,523,470 | B2 | 2/2003 | Kolbe et al. |
| 6,640,711 | B2 | 11/2003 | Smoot et al. |
| 6,647,879 | B1 | 11/2003 | Papadopoulos et al. |
| 6,669,613 | B1 | 12/2003 | Van Denend |
| 6,688,226 | B2 | 2/2004 | Rossini et al. |
| 6,691,614 | B2 | 2/2004 | Bell et al. |
| 6,725,775 | B2 | 4/2004 | Palmatier et al. |
| 6,782,821 | B2 | 8/2004 | Dilling et al. |
| 6,792,858 | B2 | 9/2004 | Kolbe et al. |
| 6,799,510 | B2 | 10/2004 | Sandstrom |
| 7,107,907 | B2 | 9/2006 | Vrotacoe |
| 7,124,685 | B2 | 10/2006 | Re et al. |
| 7,207,267 | B2 | 4/2007 | Salvestro et al. |
| 7,225,736 | B2 | 6/2007 | Blom et al. |
| 7,290,488 | B2 | 11/2007 | Petersen et al. |
| 7,624,680 | B2 | 12/2009 | Metrope |
| 7,900,559 | B2 | 3/2011 | Rasch et al. |
| 2007/0144381 | A1 | 6/2007 | Lorig et al. |

FOREIGN PATENT DOCUMENTS

| | | |
|---|---|---|
| DE | 10023742 | 11/2001 |
| EP | 0527293 | 2/1993 |
| EP | 2311637 | 4/2011 |

* cited by examiner

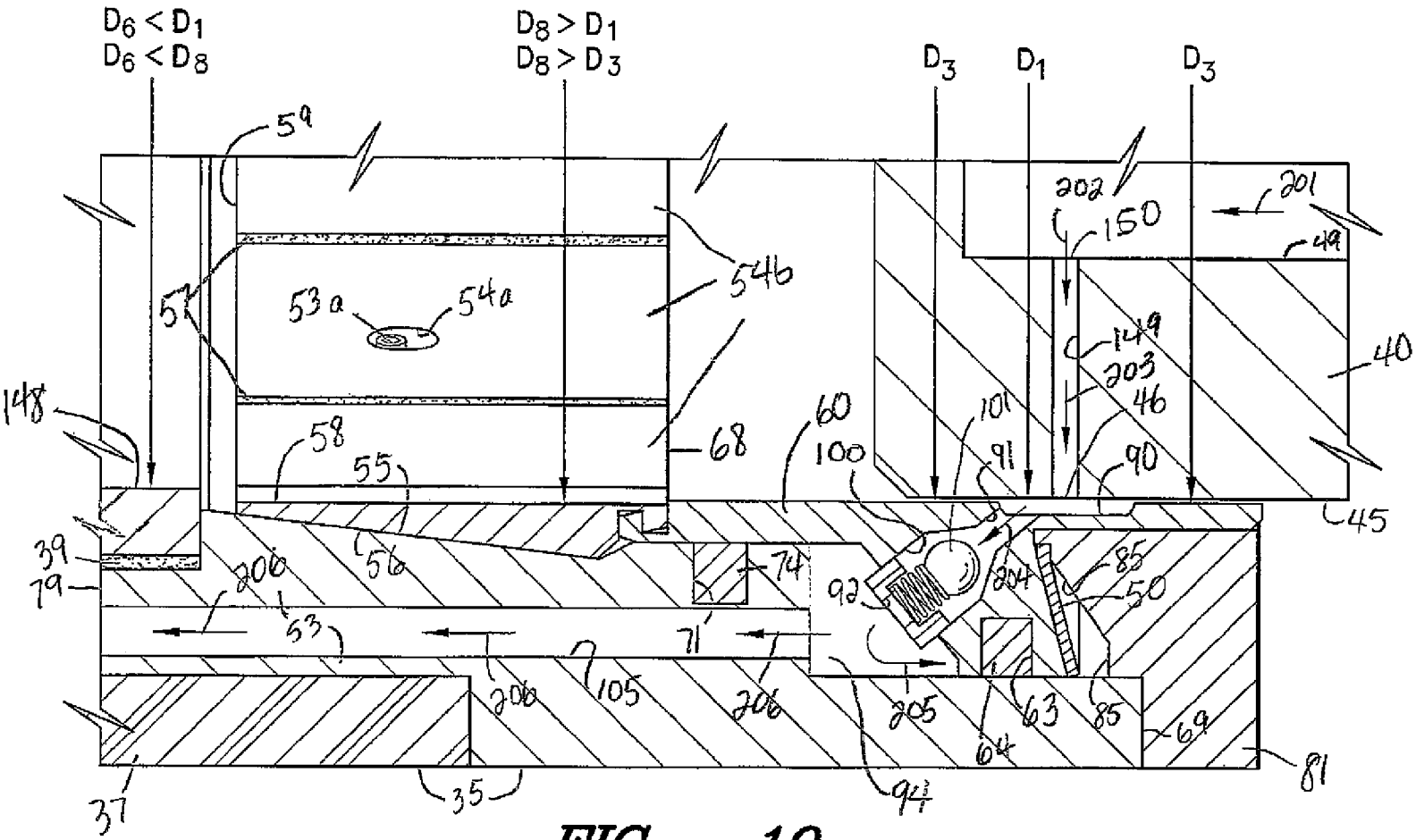
FIG. —10—

30
78
95
58
40
49
42
51
81
53
94
54

35
148
38
75
37

75
148
58
37
35
53
94
8
87
86
82
40
54
58
60
49
43

54
58
93
48
105
94
53
82
52

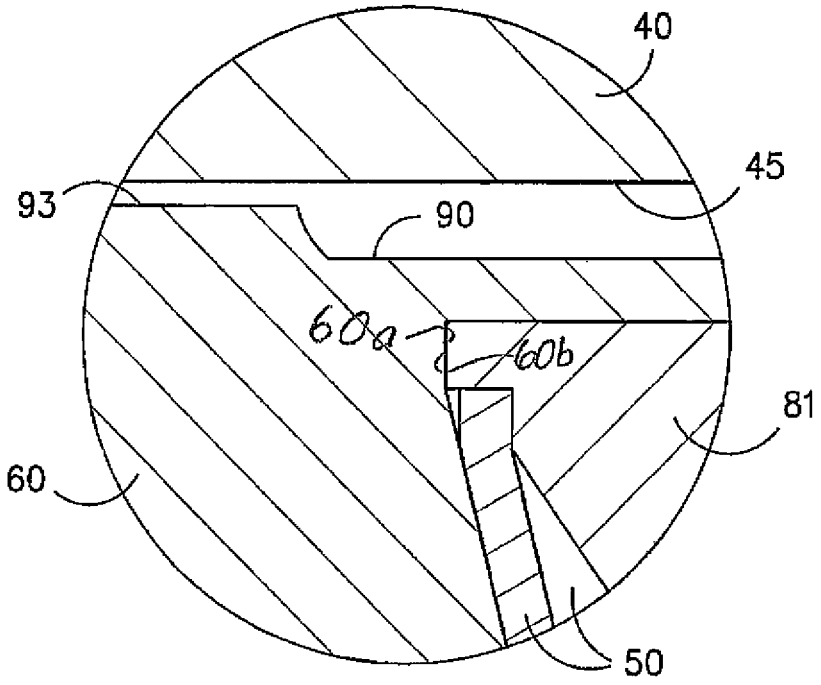
FIG. –20B–

BRIDGE SLEEVES WITH DIAMETRICALLY EXPANDABLE STABILIZERS

CROSS REFERENCE TO RELATED APPLICATIONS

The present application hereby incorporates herein in their entirety by this reference for all purposes: U.S. Provisional Patent Application Ser. Nos. 61/640,277 filed Apr. 30, 2012; 61/678,867 filed Aug. 2, 2012; 61/757,440 filed Jan. 28, 2013; and 61/786,933 filed Mar. 15, 2013 and U.S. Regular patent application Ser. No. 13/753,622 filed Jan. 30, 2013.

FIELD OF THE INVENTION

The present invention relates to bridge sleeves (aka carrier sleeves, aka adapter sleeves) that themselves can be air mounted to the mandrel of a printing machine in the flexographic, offset or rotogravure printing field and that permit air mounting of a printing cylinder onto the bridge sleeves.

BACKGROUND OF THE INVENTION

Assuming that the outside diameter of the rotary mandrel of a printing machine in the flexographic, offset or rotogravure printing field is concentric with the mandrel's axis of rotation, then as the rotational speed of the print sleeve that is mounted on that mandrel increases, maintenance of adequate print quality increasingly depends on maintaining a fixed and invariable radial distance between the outside diameter of the rotary mandrel and the inside diameter of the print sleeve. If this radial distance varies, then print quality degrades. One type of degraded print quality takes the form of lightly inked or un-inked portions of the image alternating with darkly inked portions of the image. Another type of degraded print quality arises when portions of the image contain too much ink so as to decrease the desired resolution of that portion of the image on the substrate that advances past the printing surface of the print sleeve.

Variation in this desired fixed and invariable radial distance can occur if the print sleeve is subject to vibration as the print sleeve and the mandrel rotate. Such variation in the fixed and invariable radial distance can arise when an asymmetric printing surface of the print sleeve causes uneven pressure to be applied to the print sleeve, and this uneven pressure in turn causes a vibrational resonance effect to be transmitted to the bridge sleeve that results in the bridge sleeve becoming out of round as the print sleeve and the mandrel rotate. Such variation in the fixed and invariable radial distance can also occur for example due to the rotational inertia that acts on the bridge sleeve at very high run speeds and causes the bridge sleeve to become out-of-round as the print sleeve and the mandrel rotate.

In the flexographic, offset or rotogravure printing field, in order to increase the circumference of the printing surface without increasing the diameter of the rotary mandrel, it is known to use a bridge sleeve that is disposed between the outside cylindrical (or conical) surface of a rotary mandrel of the printing machine and the inside cylindrical (or conical) surface of an actual print sleeve, which carries on its outer cylindrical surface the data and/or images that are to be printed. The use of a bridge sleeve such as disclosed in commonly owned U.S. Pat. No. 5,782,181, which is hereby incorporated herein in its entirety for all purposes, enables various print developments to be achieved with the same rotary mandrel, without the need to replace this latter (generally of steel and hence heavy or of carbon fiber and hence costly) following a change in print development compared with the previous work carried out on the same printing machine.

However, a bridge sleeve that fails to serve as a rigid concentric attachment between the outside diameter of the rotary mandrel and the inside diameter of the print sleeve will fail to maintain a fixed and invariable radial distance between the outside diameter of the rotary mandrel and the inside diameter of the print sleeve and so result in the types of unsatisfactory print quality described above.

Various methods are known for mounting a conventional bridge sleeve (defined by a hollow cylinder with a through hole) onto a rotary mandrel of a printing machine. While mounting systems employing hydraulics and mounting systems employing mechanical connections are known, these typically are more cumbersome and heavier than a much used "air mounting" system that employs a conventional bridge sleeve that has an inner core layer, which though the inner core layer is slightly expandable in the radial direction, under atmospheric conditions the inner core layer defines an inner surface diameter slightly smaller than the diameter of the outer surface of the mandrel. The difference between these diameters enables an interference fit to be achieved between the mandrel of the printing machine and the conventional bridge sleeve. Positioning the conventional bridge sleeve at one end of the mandrel, compressed air is supplied (by known methods) between the outer surface of the mandrel and the inner surface of the bridge sleeve. The compressed air expands the diameter of the inner surface of the conventional bridge sleeve sufficiently to allow the bridge sleeve to slide over a cushion of air, a so-called air bearing, onto the outer surface of the mandrel. When the supply of compressed air is ended, the diameter of the inner surface of the conventional bridge sleeve shrinks sufficiently to allow the inner surface to grip the outer surface of the mandrel in an interference fit between the mandrel and the conventional bridge sleeve. Similarly, by again feeding compressed air onto the mandrel surface (by known methods), the inner surface of the conventional bridge sleeve can be slightly expanded to enable the conventional bridge sleeve to be released from the interference fit and removed from the mandrel.

Air-mountable bridge sleeves such as disclosed in commonly owned U.S. Pat. Nos. 5,819,657; 6,688,226; and 6,691,614, each of which being hereby incorporated herein in its entirety for all purposes, is usually made with a multi-layer body comprising a rigid outer cylinder made of carbon fiber and a cylindrical inner layer with an inner cylindrical surface that defines a bore with the diameter that is slightly smaller than the diameter of the outer surface of the mandrel. This type of conventional air-mounted bridge sleeve also includes at least one elastically compressible and radially deformable layer running the length of the bridge sleeve, and this compressible layer can be disposed against the outer cylindrical surface of the bridge sleeve's cylindrical inner layer. The compressed air acting against the inner surface of the inner layer of such a conventional bridge sleeve compresses this elastically compressible and radially deformable layer, which can be made of polyurethane foam for example, to enable the inner surface of the inner layer of the bridge sleeve to expand radially as it is being mounted on the outer surface of the mandrel.

However this elastic characteristic of the compressible layers of these air-mounted bridge sleeves works at cross purposes with the need for the bridge sleeve's outer surface to remain as rigidly fixed as possible with respect to the mandrel of the printing machine in order to resist the vibrations that are generated during operation of the modern printing machines that operate at very high run speeds. When the mandrel of such a printing machine rotates at speeds necessary to advance the substrate through the printing machine at line speeds of more than about 250 meters/minute, the non-uniform forces applied by the asymmetric printing surfaces of printing plates and/or the presence of the elastically compressible and radially deformable layer in a conventional bridge sleeve result(s) in machine vibrations that cause radial displacements of the bridge sleeve's outer surface with respect to the mandrel. These radially-directed displacements are transmitted to the printing surface of the print sleeve that is carried by the bridge sleeve, thereby causing the print sleeve to bounce against the substrate in rhythm with the vibrations instead of maintaining constant pressure contact with the substrate to be printed. The bouncing of the print sleeve against the substrate to be printed causes the printed image to include alternating regions where the image is printed darker than it should be followed by a region where the image is printed lighter than it should be printed. This bouncing also can cause some regions of the image to be too heavily inked and lose the desired resolution of the image. Accordingly, when these radial displacements of the bridge sleeve resulting from non-uniform pressures applied by the asymmetric surfaces of print sleeves and/or the deformation of the compressible layer do(es) arise, they compromise print quality to an unacceptable level by causing the type of banding or skipping described above to result from the bouncing of the print sleeve against the substrate.

These unacceptable radial displacements of the air-mounted bridge sleeve with compressible layers are more likely to arise as the sleeve's length and/or diameter increases. Nonetheless, printing machines that generate line speeds exceeding 250 meters/minute are becoming the norm, and a need exists for air-mountable bridge sleeves that produce acceptable print quality. Indeed, printing machines that generate line speeds exceeding 1,200 meters/minute are being put into service. Thus, as print line speeds increase and/or the diameters of the bridge sleeve must be increased in order to accommodate the larger print repeats that are needed to perform various print jobs, these air-mounted bridge sleeves requiring a lengthwise compressible layer fail to serve as a rigid concentric attachment between the outside diameter of the rotary mandrel and the inside diameter of the print sleeve.

Moreover, the elastically compressible and radially deformable layer running the length of the conventional bridge sleeve eventually degrades under even normal usage of a conventional bridge sleeve at lower line speeds below 250 meters/minute. Once this elastically compressible and radially deformable layer degrades, the entire bridge sleeve becomes useless and must be discarded, notwithstanding the continued viability of the remaining components such as the outer carbon fiber cylinder.

To eliminate the compressible layer (with its undesirable effects) of the air-mounted bridge sleeves, hydraulic systems have been developed for mounting bridge sleeves to the mandrel of a flexographic printing machine. One such hydraulic system for mounting a bridge sleeve on the rotary mandrel has been developed by Fischer & Krecke of Germany. This is an hydraulic system that requires a specially configured mandrel that has a smaller diameter on the operator side than on the motor side of the mandrel. The bridge sleeve has two end heads on which are mounted a carbon fiber cylinder. One end head defines a larger inner diameter that will fit over the larger diameter portion of the outer surface of the mandrel, and the other end head defines a smaller inner diameter that is nonetheless slightly larger than the smaller diameter portion of the outer surface of the mandrel at the operator end of the mandrel. At each end of the mandrel there is an expandable ring, the diameter of which expands and contracts according to the introduction or withdrawal of incompressible grease that is hydraulically used to expand or contract the rings. Each of these rings expands to contact the inner diameter of the steel insert at each end of a carbon fiber tube that forms the bridge sleeve.

Windmoeller Hoelscher of Germany has a mechanism that is similar to the Fischer & Krecke mechanism. The problem with each of these mechanisms is of course that as the rings expand and contract with usage, the rings become fatigued and their expansion eventually occurs non-uniformly so that they are not round relative to the central axis of the mandrel. Thus, over time the bridge sleeve rotates asymmetrically with the rotational axis of the mandrel, and this produces a bouncing motion of the bridge sleeve that causes the print quality to deteriorate as described above for the air-mounted bridge sleeves with the compressible layers. This deterioration is exacerbated as the speed of the web to be printed increases until the print quality is deemed unacceptable. Examples of unacceptable print quality include the presence of bands in the printed image that result from the bounce of the bridge sleeve as the rings that contact the inside diameter of the bridge sleeve no longer expand uniformly in perfect concentricity with the axis of rotation of the mandrel.

Another mechanical system for mounting a bridge sleeve on a rotary mandrel was developed by Paper Converting Machine Corporation of Green Bay, Wis. and is described in U.S. Pat. No. 6,647,879. In this PCMC system, the bridge sleeve has opposed hubs on which are mounted a carbon fiber cylinder. The internal diameter of each of these hubs is expanded and contracted by a semi-circular collar that has one end pivotally connected to its respective hub and the opposite end connected to its respective hub via an eccentric cam that opens and closes a pivoting clamp of the collar so that the inside diameter of the collar can be expanded and contracted by movement of the eccentric cam, which is connected to an external hex nut that can be turned to tighten the collar onto the mandrel or loosen the collar from the mandrel.

However, one drawback to this PCMC system is the steel-to-steel contact between the inside diameter of the collar and the outside diameter of the rotary mandrel. Whenever this bridge sleeve is slid onto the mandrel, there inevitably is some damage to the exterior surface of the mandrel by contact with the inside diameter of the collar. Moreover, due to the steel-to-steel contact between the inside diameter of the collar of each hub and the outside diameter of the mandrel, whenever there is a machine malfunction that results in a web wrap up event that prevents further advancement of the web being printed, the steel inside diameter of the collar will rotate with respect to the outside diameter of the mandrel. This metal-to-metal relative rotation mars the outside diameter of the mandrel by the involved steel-to-steel scraping. As much as a three inch circumferential scrape in the outside diameter of the mandrel can be anticipated by such events, requiring re-machining and repair of the mandrel at the expense of both the mandrel repair and the cost of the lost downtime of the printing machine.

Another disadvantage of this PCMC system is the fact that when the diameter of the bridge sleeve must be increased, a commensurate increase in the size of the hubs results in a significant increase in the weight of the bridge sleeve. Government workplace rules typically limit the weight of the bridge sleeve to no more than 50 pounds. Still another drawback to this PCMC system is the fact that the earn eventually starts to wear with use. Such wear then causes the collar to become loose and move with respect to the stabilizer. These movements cause the bridge sleeve to lose concentricity with the mandrel, which results in the bounce that causes deterioration of the print quality as described above. These unacceptable effects due to movement of the collar become more noticeable as the speed of rotation of the bridge sleeve increases and/or as the diameter and/or length of the bridge sleeve increases.

BRIEF DESCRIPTION OF THE INVENTION

Aspects and advantages of the invention are set forth below in the following description, or may be obvious from the description, or may be learned through practice of the invention. Those of ordinary skill in the art will better appreciate the features and aspects of such embodiments, and others, upon review of the specification.

One embodiment of the present invention includes an improved bridge sleeve with a rigid stabilizer at each opposite end of the sleeve that diametrically expands using compressed air for easy mounting of the sleeve onto the printing machine's mandrel. Another embodiment of the improved bridge sleeve of the present invention need not include the elastically compressible and radially deformable layer running the entire length of the conventional bridge sleeve. This improved bridge sleeve of the present invention nonetheless exhibits sufficiently high rigidity so as not to deform unacceptably during its use on the printing machine that is running line speeds as high as 1,200 meters per minute.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 10 schematically illustrates an enlarged cross-sectional view of part of the motor end of the embodiment of the bridge sleeve shown in FIG. 8A, after the pressurized air is introduced into the stabilizers.

FIG. 20B schematically illustrates after the pressurized air is introduced into the stabilizers, an enlarged cross-sectional view of part of an embodiment of the motor end of a bridge sleeve of the present invention depicted in the balloon shown in FIG. 13D to schematically illustrate the self-centering of the annular piston of the stabilizers.

DETAILED DESCRIPTION OF THE INVENTION

Figure 1:
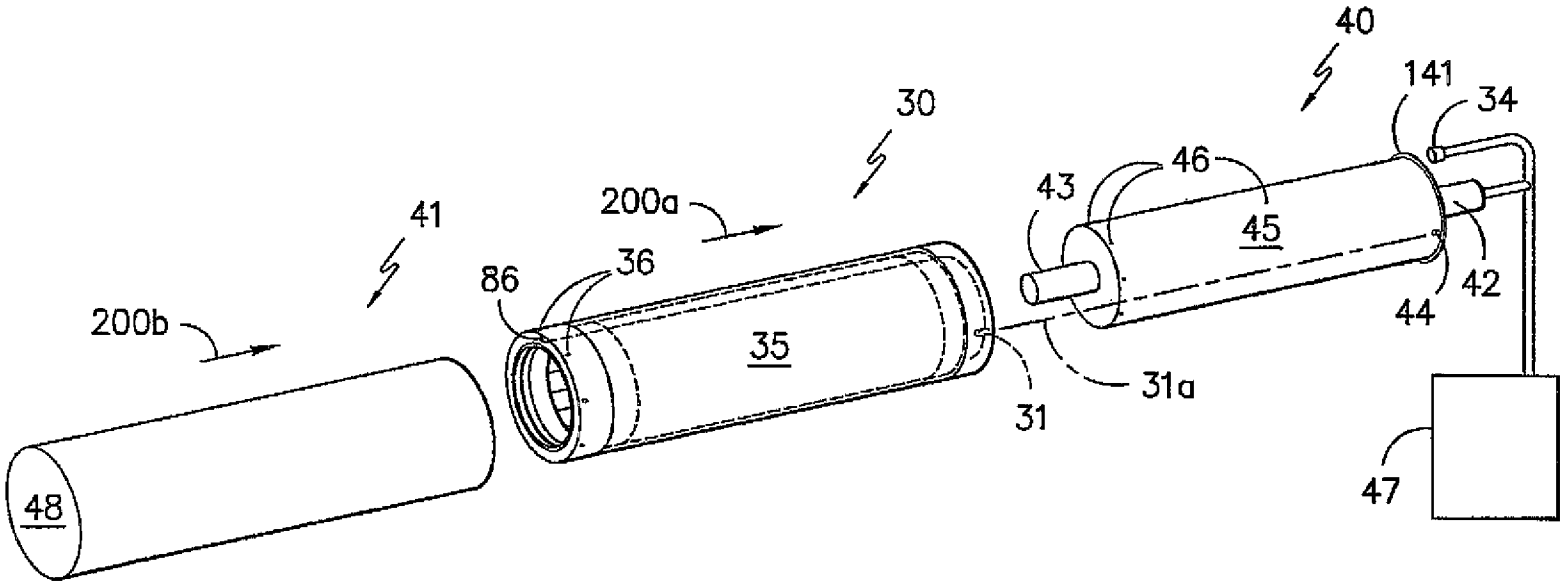
FIG. 1 schematically represents in an elevated perspective view, an embodiment of a bridge sleeve in accordance with the invention that is air-mountable on a mandrel of a printing machine housed in a plant where a supply of compressed air is available, and on which bridge sleeve a print sleeve can be air-mounted.

Reference will now be made in detail to exemplary embodiments of the invention, examples of which are illustrated in the accompanying drawings. The detailed description uses numerical and letter designations to refer to features in the drawings. Like or similar designations in the drawings and description have been used to refer to like or similar features.

Each example is provided by way of explanation of the invention, not limitation of the invention. In fact, it will be apparent to those skilled in the art that modifications and variations can be made in the present examples of the invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

References to the axial refer to the lengthwise direction in which the cylindrical sleeve or mandrel or annulus or ring elongates along an axis of rotation. References to the radial refer to the transverse direction in which the cylindrical sleeve or mandrel or annulus or ring extends outwardly or inwardly in a perpendicular direction relative to the axis of rotation. References to the circumferential refer to the tangential direction with respect to the cylindrical surface of the sleeve or mandrel or annulus or ring. A reference to the diameter of a surface refers to the diameter of the circle that defines the intersection of the surface with a plane that is normal to the axis of rotation of the surface. The meaning of additional reference terms will become apparent through their usages in the text that follows.

FIG. 1 schematically depicts an elevated view of an exemplary embodiment of a bridge sleeve 30 of the present invention. This bridge sleeve 30 is shown in relation to a mandrel 40 of a printing machine (not shown) and in relation to a print sleeve 41. As schematically shown in FIG. 1, the mandrel 40 has a journal 42 or 43 at each opposite end that is axially aligned about the central axis of rotation of the mandrel 40. The so-called motor journal 42 is received in the printing machine and is located farthest away from the operator when the printing machine is in use. While the so-called operator journal 43 is on the end of the mandrel 40 that is closest to the operator when the printing machine is in use. As is conventional, the so-called motor end of the mandrel 40 has a registration pin 44 extending radially from the outer surface 45 of the mandrel 40 near where the motor end of the mandrel 40 defines an annular shoulder 141 that is present on many modern mandrels 40.

Figure 2:
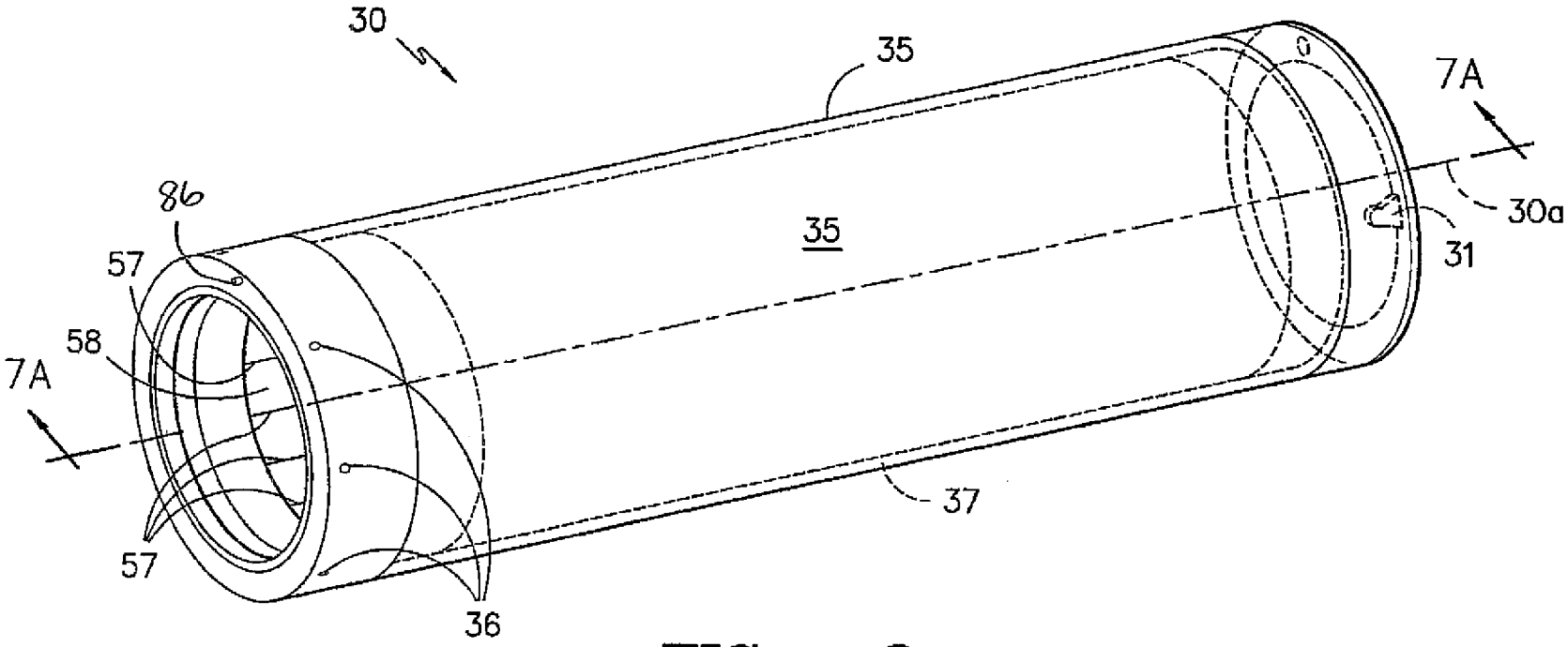
FIG. 2 schematically represents an elevated perspective view of an embodiment of a bridge sleeve in accordance with the invention.
Figure 13B:
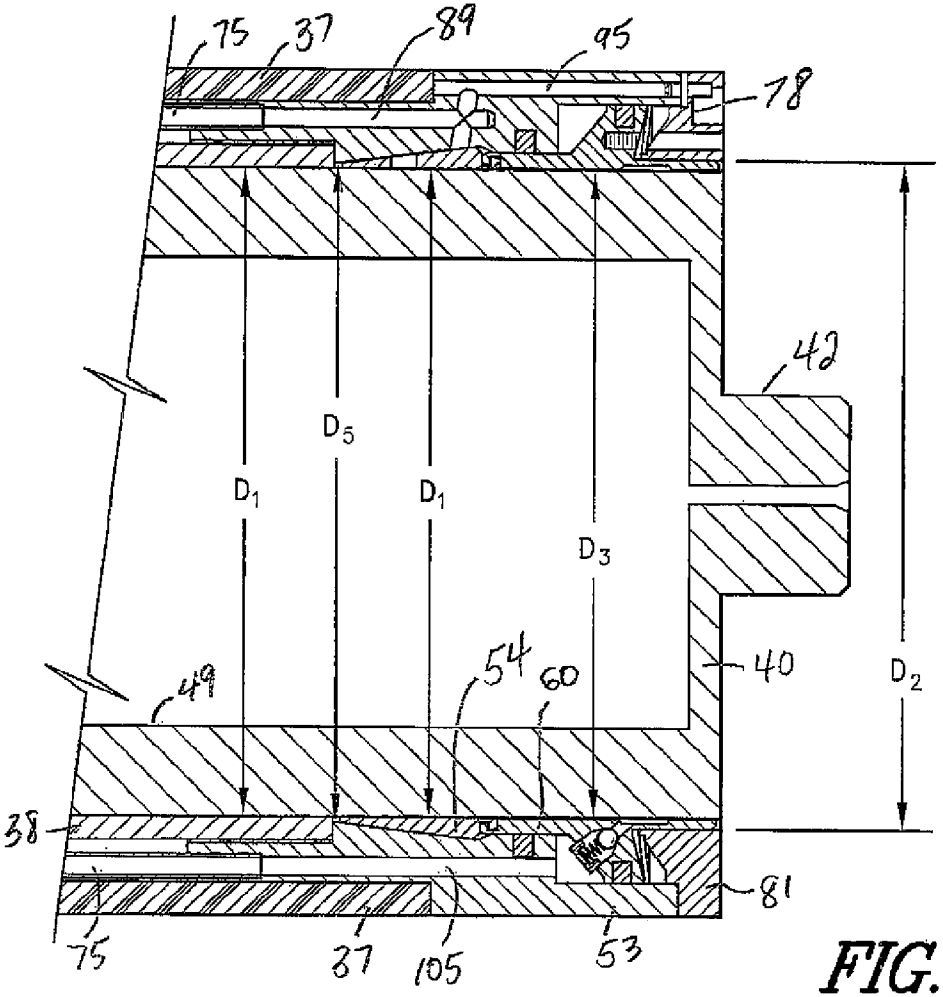
FIG. 13B schematically represents a cross-sectional view of an inventive embodiment of a motor end of a bridge sleeve mounted on the mandrel and showing various relative diametric dimensions before the pressurized air enters the stabilizers.
Figure 13C:
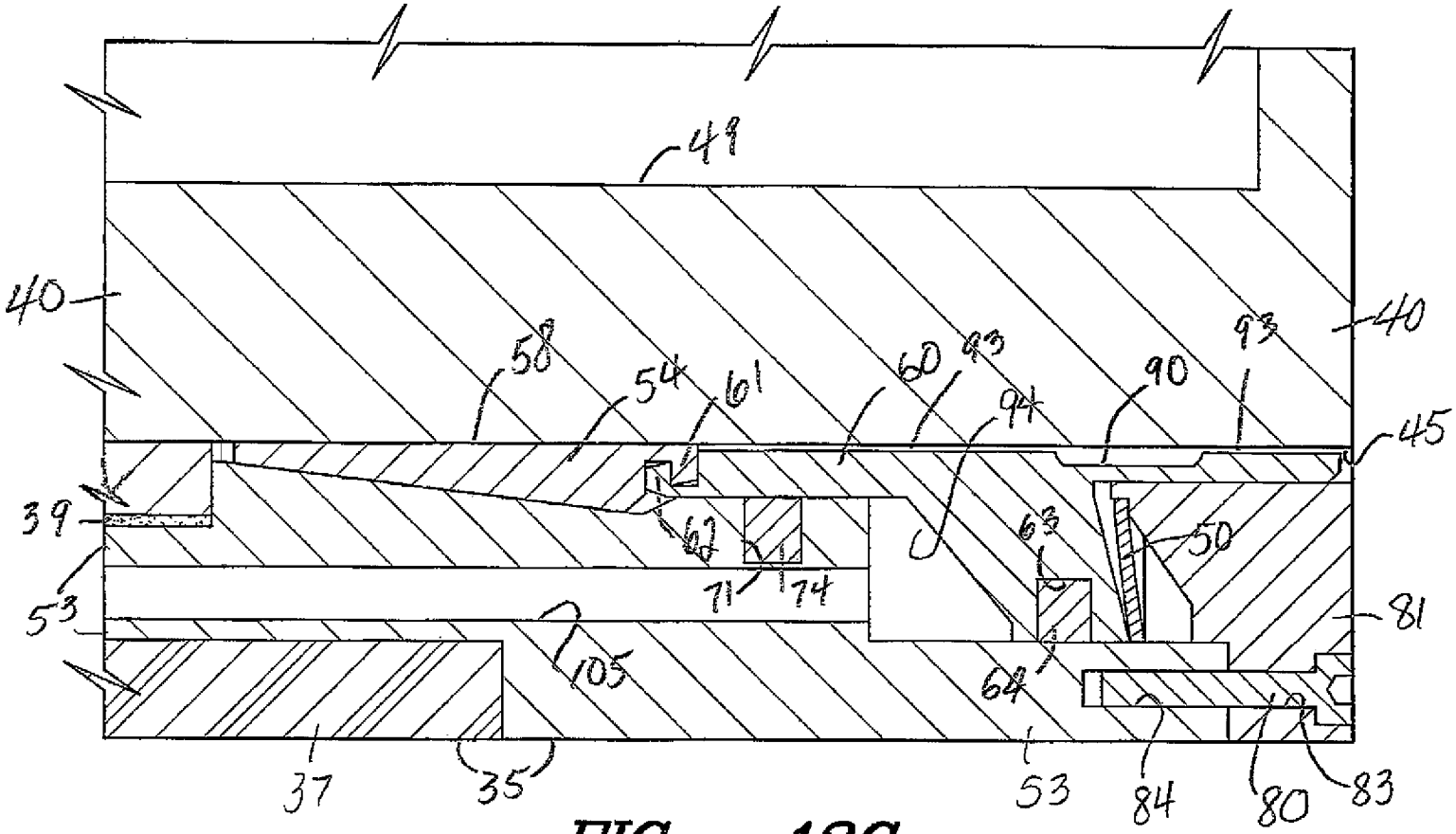
FIG. 13C schematically represents a cross-sectional view (taken along the sight arrows designated 13C-13C in FIG. 6) of an inventive embodiment of a motor end of a bridge sleeve before the pressurized air enters the stabilizers.
Figure 13D:
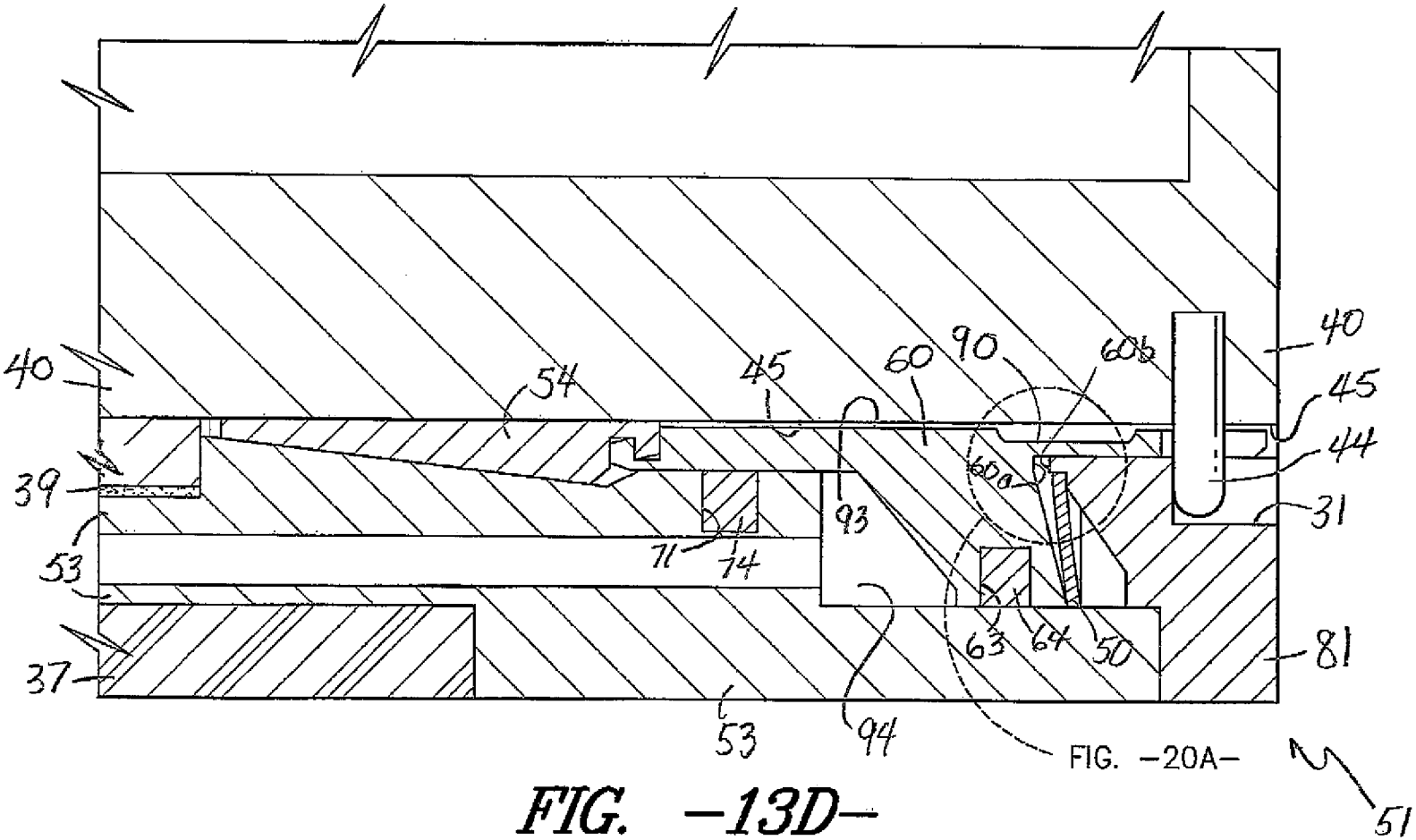
FIG. 13D schematically represents a cross-sectional view (taken along the sight arrows designated 13D-13D in FIG. 6) of an inventive embodiment of a motor end of a bridge sleeve mounted on the mandrel before the pressurized air enters the stabilizers.

As shown in FIGS. 1, 2 and 13D for example, the so-called motor end of the bridge sleeve 30 has a registration notch 31 that receives therein, the registration pin 44 of the mandrel 40 when the bridge sleeve 30 is properly aligned on the mandrel 40. The dashed line designated 31*a* in FIG. 1 schematically indicates the alignment of the registration notch 31 with the registration pin 44 as the bridge sleeve 30 moves in the mounting direction schematically indicated by the arrow designated 200*a* onto the mandrel 40. The dashed line designated 30*a* in FIG. 1 schematically indicates the axial center line and axis of rotation of the bridge sleeve 30 and would coincide with the axis of rotation of the mandrel 40.

As is conventional in the art and schematically shown in FIG. 1, the so-called operator end of the mandrel 40 desirably can be provided with a plurality of air holes 46 through which compressed air can be supplied to the outer surface 45 of the mandrel 40 from a supply 47 of pressurized air that can be associated with the printing machine or can be available in the facility that houses the printing machine. Though not visible in the scale of the drawing of FIG. 1, the air holes 46 at the operator end of the mandrel 40 desirably can be arranged in a circumferentially extending groove that promotes circumferentially even distribution of the compressed air to the outer surface 45 of the mandrel 40.

The bridge sleeve 30 of the present invention can be configured so that using only the pressurized air that is supplied to the mandrel 40, the bridge sleeve 30 can be alternately air-mounted onto the mandrel 40 and dismounted from the mandrel 40. Alternatively, the bridge sleeve 30 can be configured for connection to a separate supply of compressed air from the pressurized air that is supplied through the mandrel 40, and this separate supply of compressed air can be used to mount or dismount the bridge sleeve 30 onto the outer surface 45 of the mandrel 40.

As shown in FIG. 2, the outer surface 35 of the bridge sleeve 30 is defined by the cylindrical outer surface of the rigid outermost layer 37 of the bridge sleeve 30. This rigid outermost layer 37 of the bridge sleeve 30 desirably is defined by a carbon fiber composite material that is rigid, light in weight and desirably at least as strong as steel. The carbon fiber in this rigid outermost layer 37 of the bridge sleeve 30 desirably is oriented parallel to the rotational axis of the bridge sleeve 30 and provides the rigid outermost layer 37 with maximum rigidity.

The bridge sleeve 30 desirably includes a stabilizer 51, 52 disposed near each opposite end of the bridge sleeve 30. Each stabilizer 51, 52 is provided with an inner contacting surface 58 by which the particular stabilizer 51 or 52 comes into contact with the outer surface 45 of the mandrel 40. Moreover, in accordance with one aspect of the present invention, the stabilizers 51, 52 can be actuated so that together they provide a rigid, concentric attachment and support between the outer surface 45 of the rotary mandrel 40 and the inner surface 48 of the print sleeve 41 (FIG. 2) that is mounted on the outer surface 35 of the bridge sleeve 30. However, in order to be able to mount and dismount the bridge sleeve 30 to and from, respectively, the mandrel 40, a mechanism is provided to expand the diameter of the inner contacting surface 58 of each stabilizer 51, 52 sufficiently to permit the bridge sleeve 30 to slide axially over the outer surface 45 of the mandrel 40 without contact between the outer surface 45 of the mandrel 40 and the inner contacting surface 58 of each stabilizer 51, 52. The variance in the diameter of the inner contacting surface 58 of each stabilizer 51, 52 desirably can range between slightly less than the diameter of the outer surface 45 of the mandrel 40 of the intended printing machine and a diameter that is about 0.4 millimeters larger than the diameter of the outer surface 45 of the mandrel 40 of the intended printing machine. Larger diametric ranges for this variance in the diameter of the inner contacting surface 58 of each stabilizer 51, 52 also can be accommodated. The inclusion of these rigid stabilizers 51, 52 assures that the radial distance between the bridge sleeve's rigid outer surface 35, which can be formed of a carbon fiber cylinder, and the equally rigid outer surface 45 (typically composed of steel) of the mandrel 40 of the printing machine remains unvarying and constant, even at line speeds in excess of 1,200 meters per minute.

Figure 3:
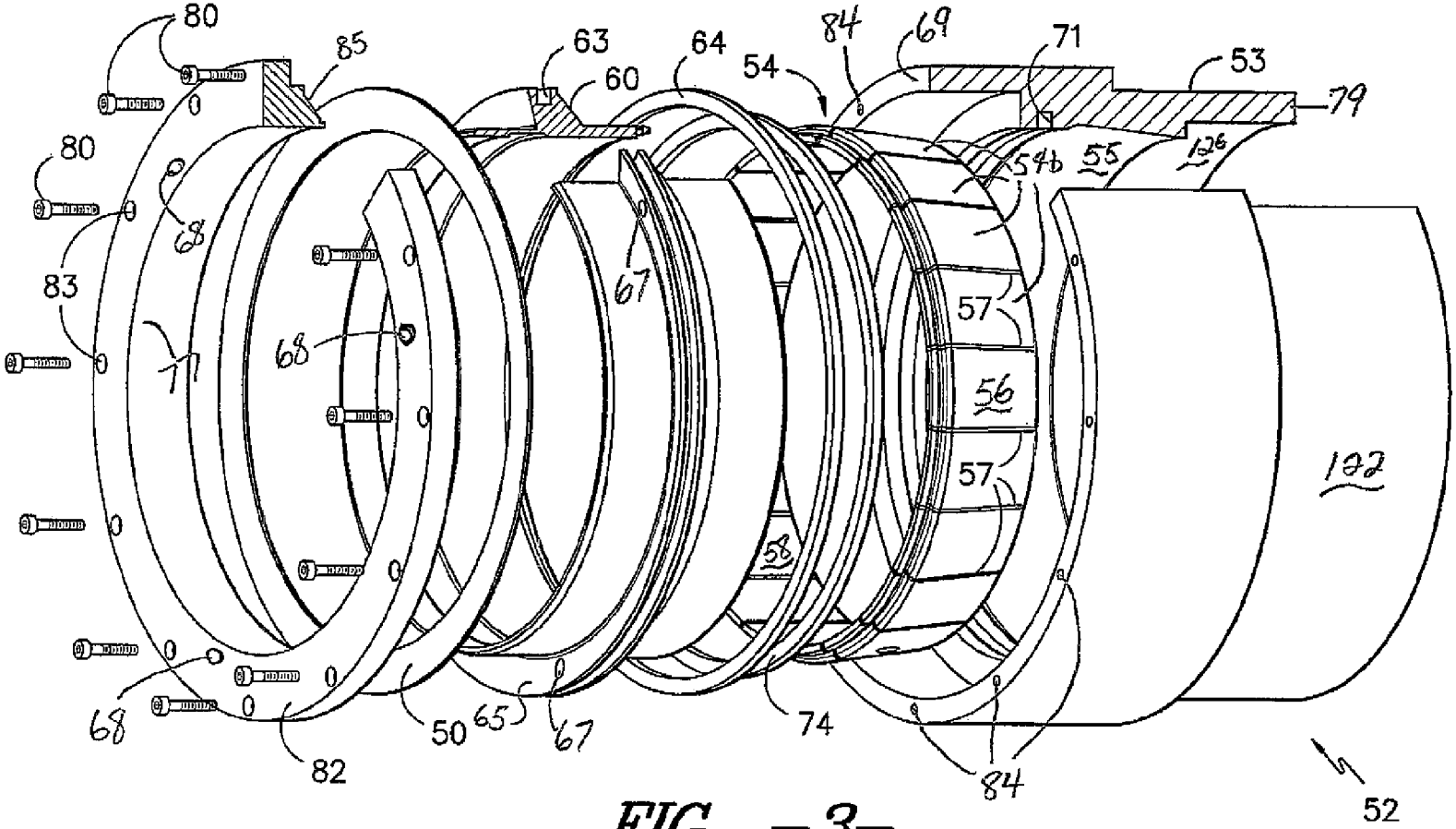
FIG. 3 schematically represents an unassembled perspective view of an inventive embodiment of a stabilizer for the operator end of an inventive embodiment of a bridge sleeve, showing the fully expanded slots that indicate the maximum inner diameter of the stabilizer.
Figure 4:
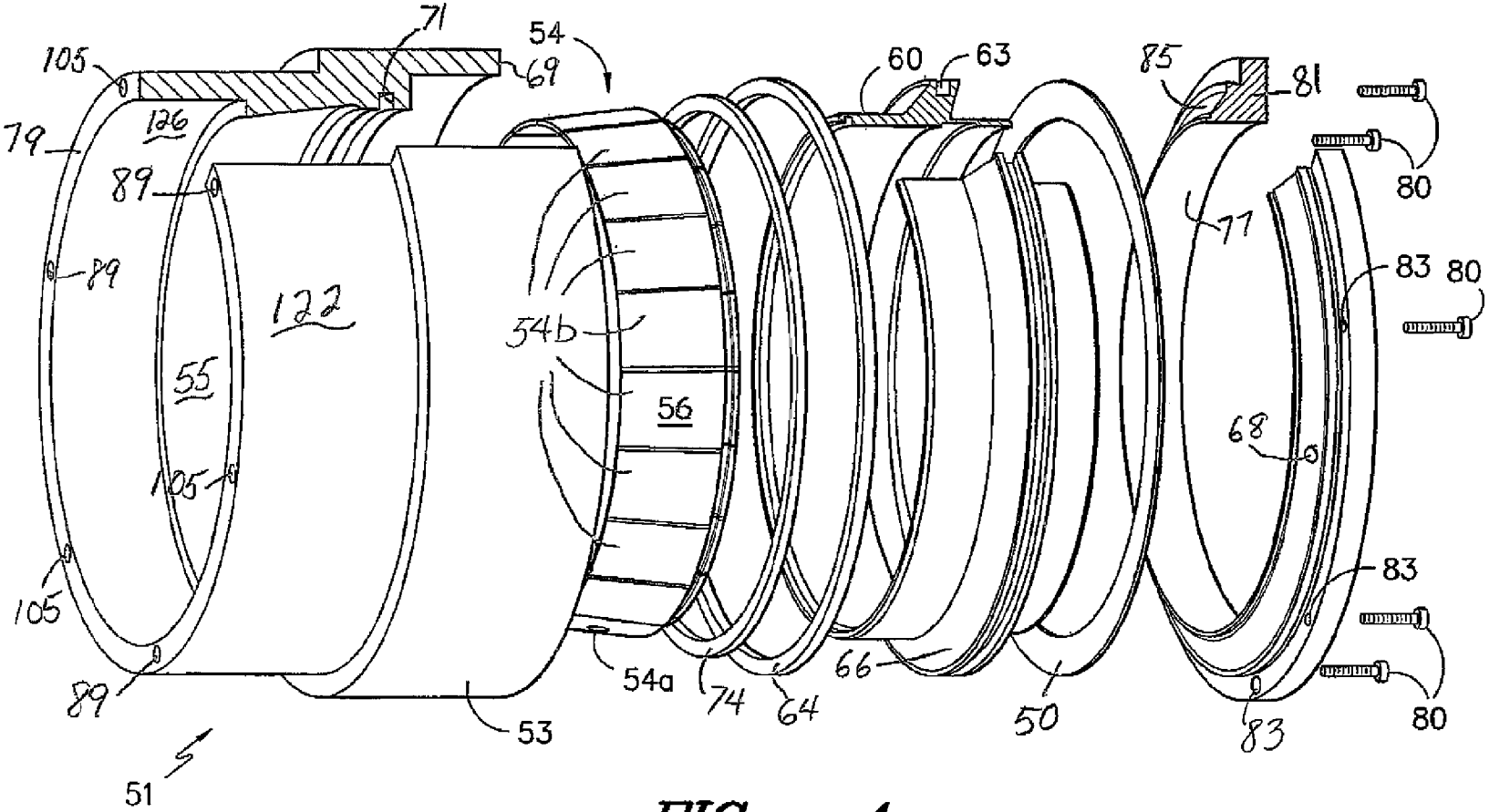
FIG. 4 schematically represents an unassembled perspective view of an inventive embodiment of a stabilizer for the motor end of an inventive embodiment of the bridge sleeve, showing the fully expanded slots that indicate the maximum inner diameter of the stabilizer.

An embodiment of a first stabilizer 51 that desirably is disposed near the motor end of an embodiment of a bridge sleeve 30 is shown with its components in a disassembled state in FIG. 4, in which portions of some of those components have been cut away to better reveal and facilitate description of certain of their features. The first stabilizer 51 (aka motor end stabilizer 51) is disposed at the end of the bridge sleeve 30 that is first slid onto the operator end of the mandrel 40 having the air holes 46 when the bridge sleeve is being mounted onto the mandrel 40. An embodiment of a second stabilizer 52 (aka operator end stabilizer 52) that desirably is disposed near the operator end of an embodiment of a bridge sleeve 30 is shown with its components in a disassembled state in FIG. 3, in which portions of some of those components have been cut away to better reveal and facilitate description of certain of their features.

Figure 5:
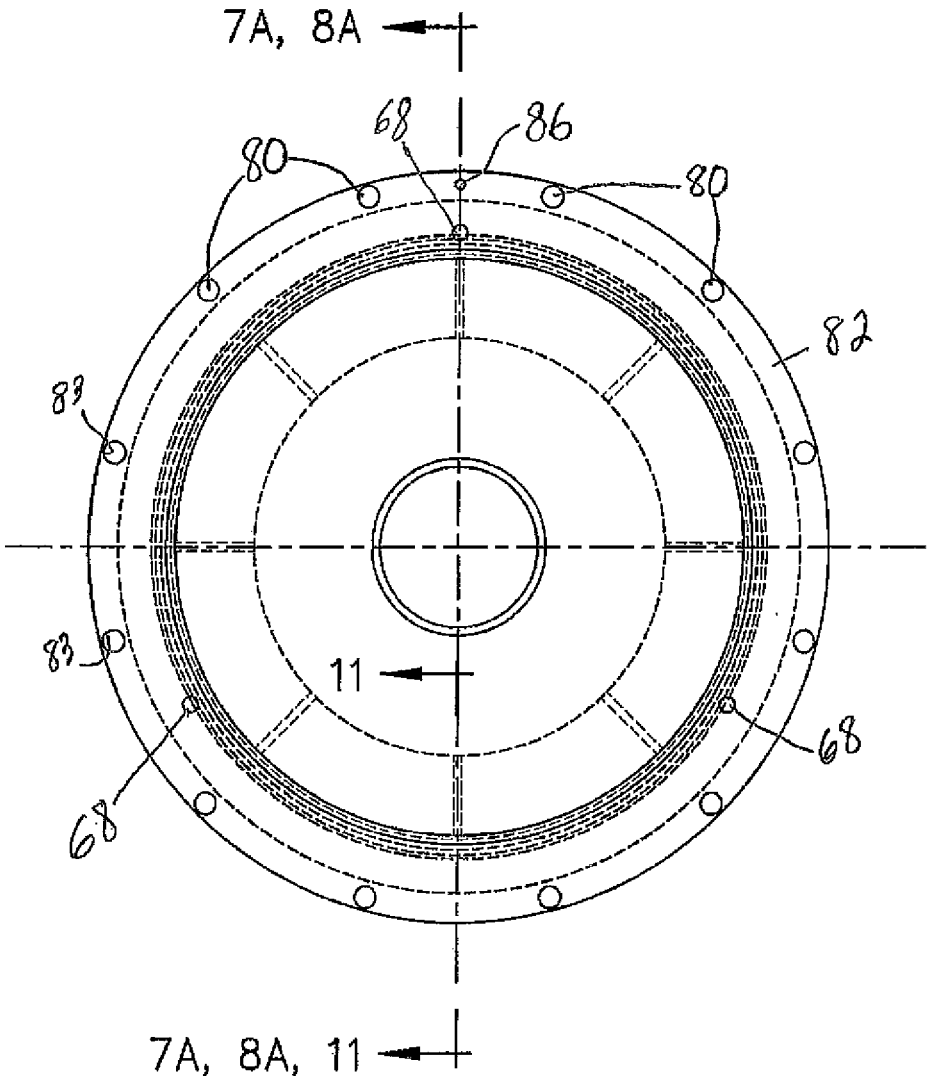
FIG. 5 schematically represents a front plan view of the operator end of an inventive embodiment of the stabilizer of FIG. 3.
Figure 6:
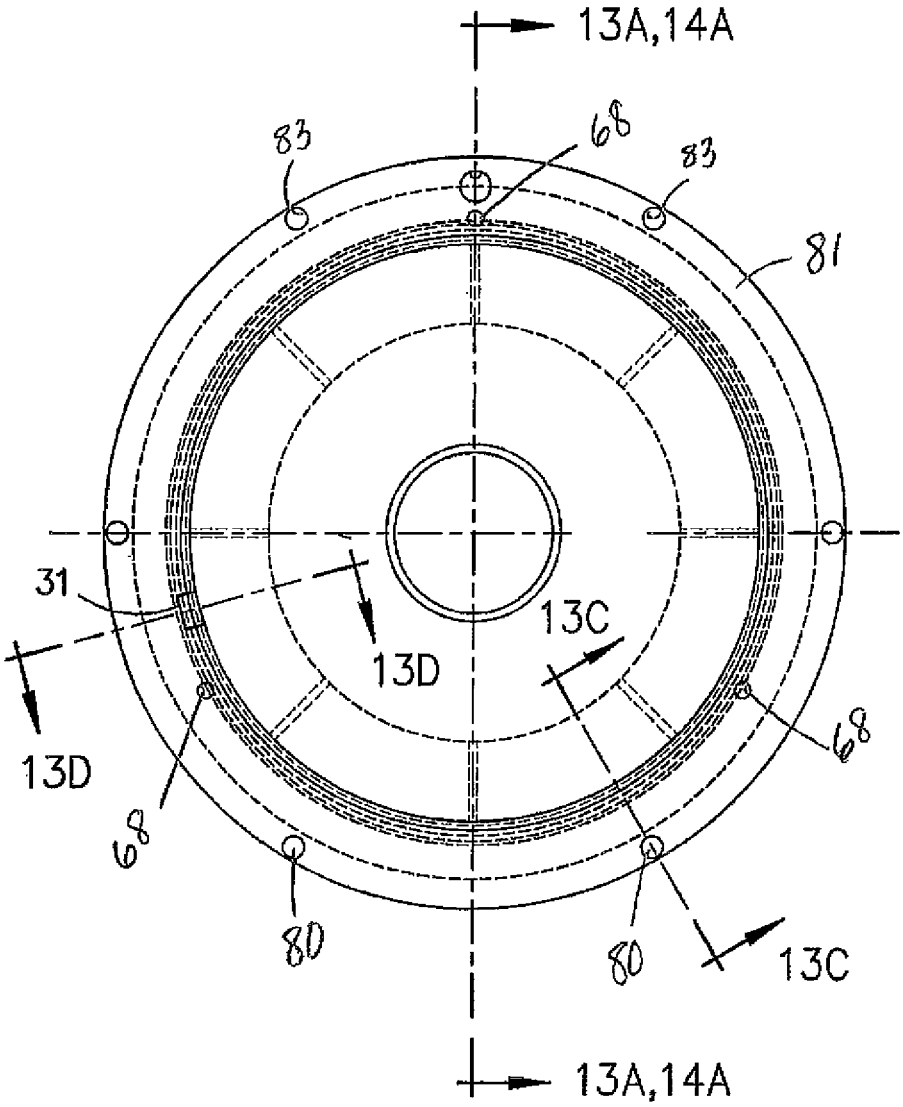
FIG. 6 schematically represents a front plan view of the motor end of an inventive embodiment of the stabilizer of FIG. 4.
Figure 7A:
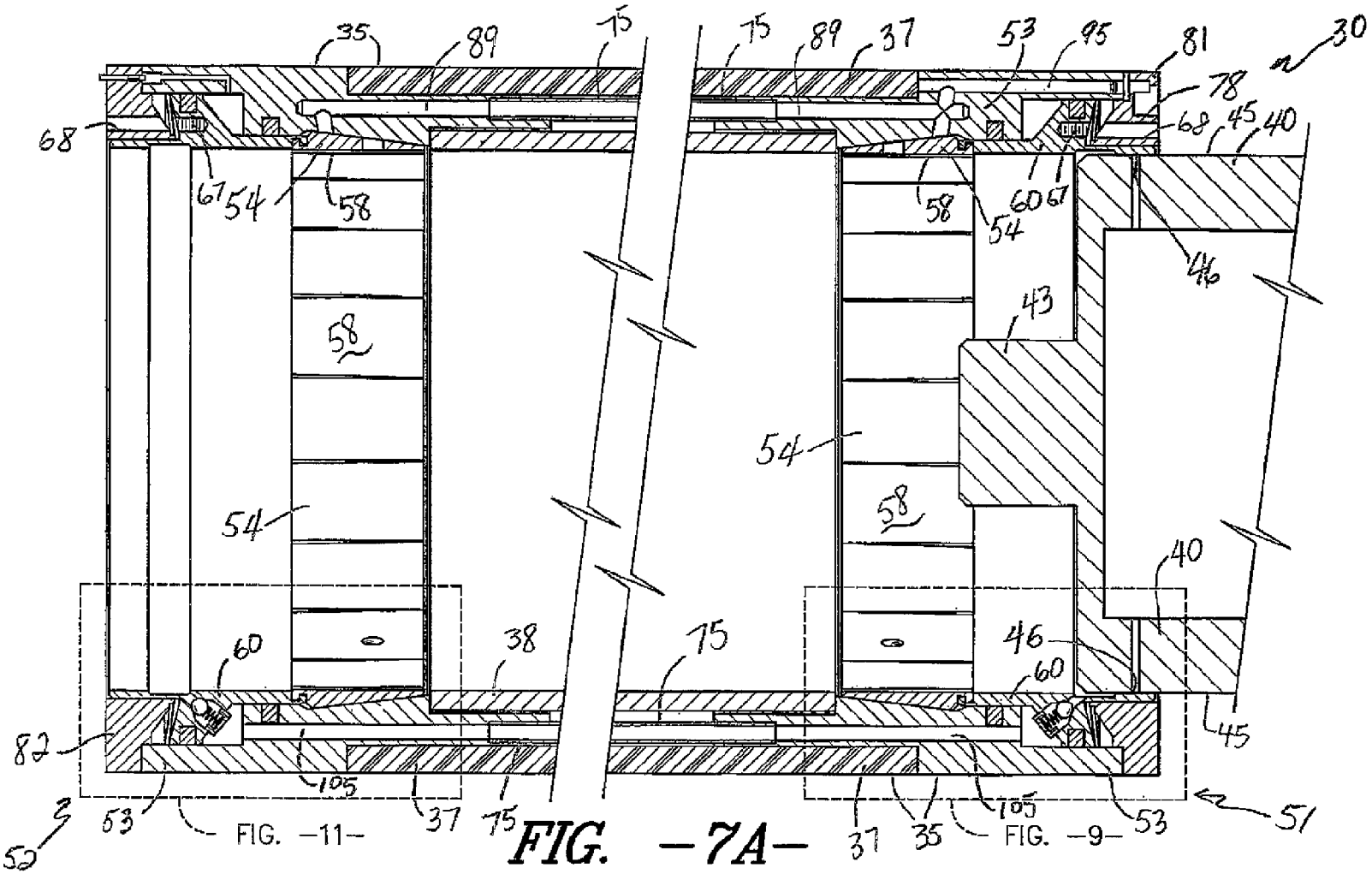
FIG. 7A schematically represents a cross-sectional view (taken along the sight arrows designated 7A-7A in FIG. 5) of an inventive embodiment of a bridge sleeve (broken in the middle) being mounted onto the operator end of the mandrel before the pressurized air is introduced into the stabilizers.
Figure 8A:
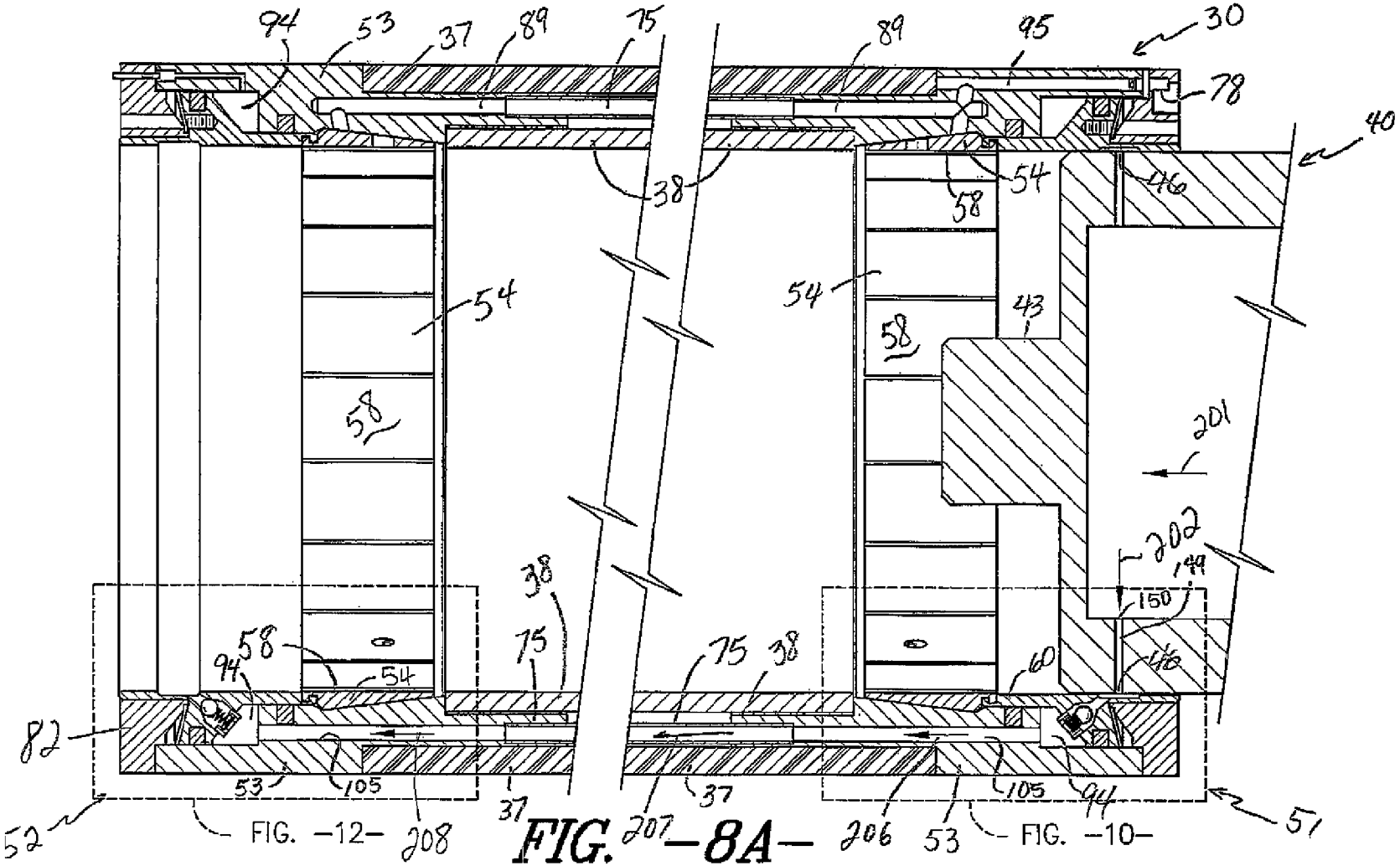
FIG. 8A schematically represents a cross-sectional view (taken along the sight arrows designated 8A-8A in FIG. 5) of an inventive embodiment of a bridge sleeve (broken in the middle) being air mounted onto the operator end of the mandrel after the pressurized air is introduced into the stabilizers to expand the inner diameter thereof larger than the outside diameter of the mandrel.

An end-on plan view of the motor end of the bridge sleeve 30 depicted in FIG. 2 is shown in FIG. 6 with the components of the first stabilizer 51 in their assembled arrangement. Similarly, an end-on plan view the operator end of the bridge sleeve 30 depicted in FIG. 2 is shown in FIG. 5 with the components of the second stabilizer 52 in their assembled arrangement. A view from a plane passing through the central axis of rotation 30*a* of the bridge sleeve 30 depicted in FIG. 2 is shown in FIGS. 7A and 8A with the components of the two stabilizers 51 and 52 in their assembled arrangement. In FIG. 7A, the stabilizers 51 and 52 are shown with their various components oriented as they would be when the bridge sleeve 30 is purged of any pressurized air such as when the bridge sleeve 30 has been removed from the mandrel 40. In FIG. 8A, the stabilizers 51 and 52 are shown with their various components oriented as they would be when the motor end of the bridge sleeve 30 is advanced onto the operator end of the mandrel 40 sufficiently to be receiving pressurized air (schematically indicated by the arrows) from the air holes 46 of the mandrel 40 that pressurizes the stabilizers 51, 52 but before the pressurized air reaches and expands the radially expandable cylindrical inner core 38 of the bridge sleeve 30.

Figures 13A, 15, 16:
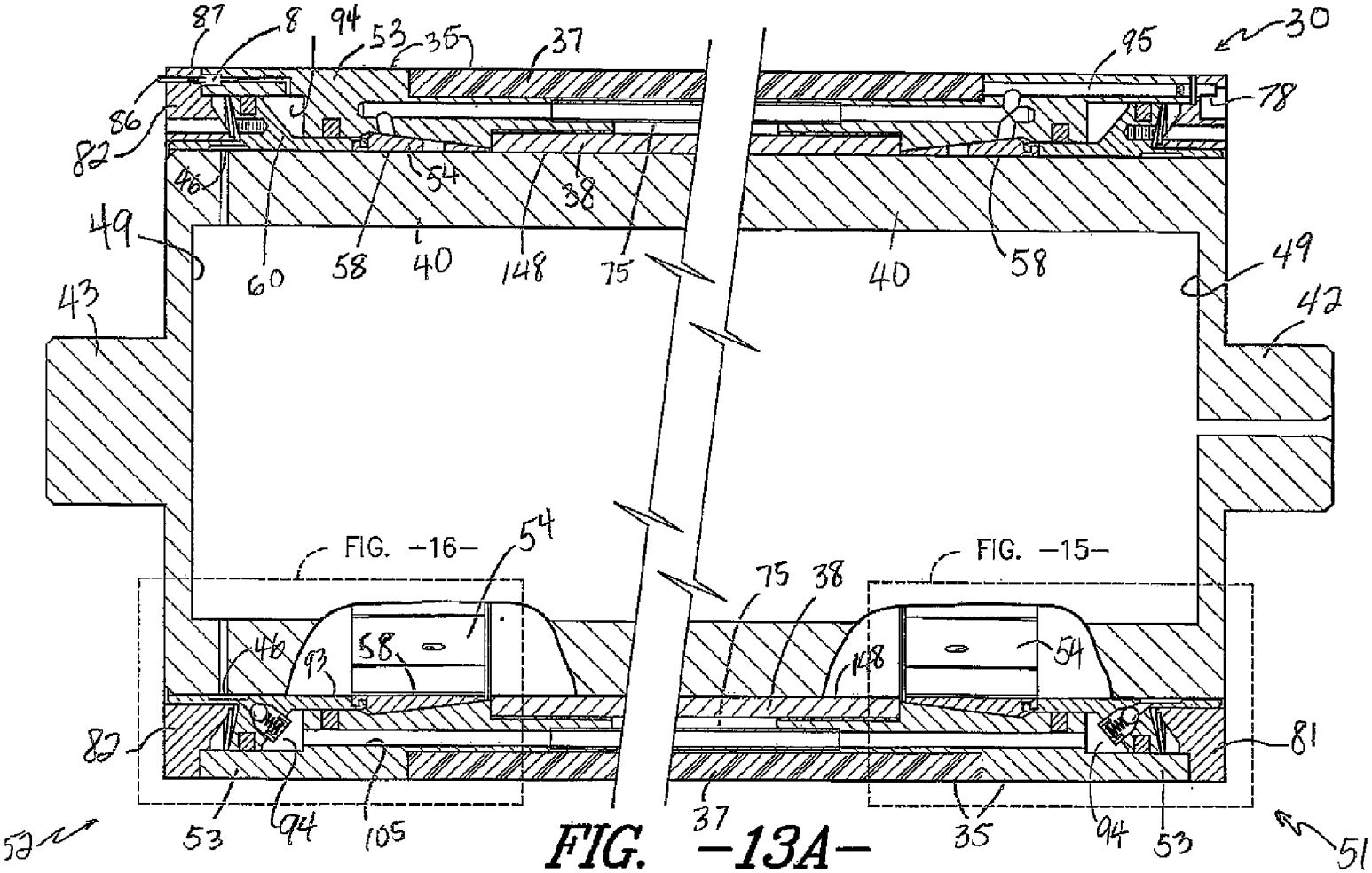
FIG. 13A schematically represents a cross-sectional view (taken along the sight arrows designated 13A-13A in FIG. 6) of an inventive embodiment of a bridge sleeve (broken in the middle) mounted on the mandrel before the pressurized air is introduced into the stabilizers.
FIG. 15 schematically illustrates an enlarged cross-sectional view of part of the motor end of the embodiment of the bridge sleeve shown in FIG. 13A, before the pressurized air is introduced into the stabilizers.
FIG. 16 schematically illustrates an enlarged cross-sectional view of part of the operator end of the embodiment of the bridge sleeve shown in FIG. 13A, before the pressurized air is introduced into the stabilizers.

As shown in FIGS. 3 and 4, each respective stabilizer 51, 52 includes an outer shell 53 and an inner shell 54 that is configured to nest at least partially within the outer shell 53. The outer shell 53 and the inner shell 54 of each of the stabilizers 51, 52 desirably is formed of rigid incompressible material such as steel or carbon fiber composite material. The outer shell 53 of the first stabilizer 51 desirably is configured almost identically as is the outer shell 53 of the second stabilizer 52, and both outer shells 53 desirably are composed of aluminum that is hard anodized and yet is light in weight. As shown in FIGS. 2 and 13A for example, the main difference between the two outer shells 53 is the provision of an air release valve that can be activated by pressing a pin 86 extending from the operator end stabilizer 52 to release pressurized air from the air circuit that activates the stabilizers 51, 52. The number and arrangement of the axially extending holes by which the respective annular end cap 81, 82 is attached to the outwardly facing edge of the outer shell 53 also can differ as between the outer shell 53 for the first stabilizer 51 and the outer shell 53 for the second stabilizer 52.

Though only visible in the view of the first stabilizer 51 in FIG. 4, each outer shell is provided with six axially extending air passages 105 or 89 arranged at 60 degree intervals around the circumference of the outer shell 53. As schematically shown in FIGS. 7A and 8A for example, three air passages 89 arranged at 120 degree intervals form part of the separate pressurized air circuit that is devoted to conveying pressurized air to the holes 36 (not shown in the cross-section taken in FIGS. 7A and 8A) through the outer surface 35 of the bridge sleeve 30 to mount and dismount the print sleeve 41 from the surface 35 of the bridge sleeve 30. As schematically shown in FIGS. 7A and 8A for example, the separate pressurized air circuit conveying pressurized air to the holes 36 also includes axially extending hollow tubes 75 that connect the air passages 89 in the outer shell 53 of the first stabilizer 51 to the air passages 89 in the outer shell 53 of the second stabilizer 52. This pressurized air circuit is configured to provide pressurized air to the air holes 36 (FIGS. 1 and 2) at the outer surface 35 of the bridge sleeve 30 to create a thin air bearing of pressurized air between the inner surface 48 of the print sleeve 41 and the outer surface 35 of the bridge sleeve 30. This air bearing of pressurized air slightly expands the diameter of the inner surface 48 of the print sleeve 41 (FIG. 1) so that the print sleeve 41 can slide just above the outer surface 35 of the bridge sleeve 30 and thereby alternately become air-mounted onto or removed from the outer surface 35 of the bridge sleeve 30. This thin layer of pressurized air that forms the co-called air bearing enables the operator to slide the print sleeve 41 axially in the direction schematically indicated in FIG. 1 by the arrow designated 200*b* until the print sleeve 41 envelops the outer surface 35 of the bridge sleeve 30. When the supply 47 of pressurized air is discontinued, the air layer disappears, the diameter of the inner surface 48 of the print sleeve 41 contracts to the diameter of the outer surface 35 of the bridge sleeve 30 and thus tightly grips the outer surface 35 of the bridge sleeve 30 in a manner that prevents both relative axial movement and circumferential movement between the print sleeve 41 and the bridge sleeve 30 under normal operating conditions of the printing machine.

As schematically indicated in FIG. 1, the bridge sleeve 30 is further configured so that air-mounting the print sleeve 41 onto the outer surface 35 of the bridge sleeve 30 can be accomplished with either a flow-through air-mounting system or a piped air-mounted system. As schematically shown in FIGS. 7A, 8A, 13A and 14A for example, a so-called piped embodiment of the bridge sleeve 30 can be configured with an air portal 78 for connection to a separate supply of compressed air from the pressurized air that is supplied through the mandrel 40. As schematically indicated in FIG. 1, this separate supply of compressed can be connected to the air portal 78 of the bridge sleeve 30 via a fitting 34 that automatically is connected to the air portal 78 when the bridge sleeve 30 is mounted on the mandrel and aligned with the registration pin 44 of the mandrel 40. As schematically shown in FIGS. 7A, 8A, 13A and 14A, the air portal 78 can be connected via a conduit 95 to axial air passages 89 in the outer shell 53 of the motor stabilizer 51. Once so connected, the pressurized air can be piped via axial air passages 89 in the outer shell 53 through the bridge sleeve 30, axially and radially, and expelled via the holes 36 (FIGS. 1 and 2) through the outer surface 35 of the bridge sleeve 30 and thus used to mount the print sleeve 41 onto the outer surface 35 of the bridge sleeve 30 and alternately dismount the print sleeve 41 from the outer surface 35 of the bridge sleeve 30.

Alternatively, a so-called flow-through embodiment of the bridge sleeve 30 can be configured so that the pressurized air that is supplied through the mandrel 40 flows radially through the bridge sleeve 30 and to the outer surface 35 of the bridge sleeve 30 and is used to mount the print sleeve 41 onto the outer surface 35 of the bridge sleeve 30. Because air flow through mounting circuits for bridge sleeves are known, they will not be further described here.

The bridge sleeve 30 desirably includes two separate pressurized air circuits that receive pressurized air from a source outside of the bridge sleeve 30. The three air passages 105 shown schematically in the view of the first stabilizer 51 in FIG. 4 are arranged at 120 degree intervals and form part of the second separate pressurized air circuit that is devoted to conveying pressurized air to actuate the stabilizers 51, 52 as explained more fully below.

The inner shell 54 of each of the stabilizers 51, 52 desirably is formed of resilient spring steel. For example, each inner shell 54 desirably is formed of 90 kg drawn steel sheet that has been tempered. However, in alternative embodiments of the stabilizers 51, 52, it is desirable to form the inner shell 54 of carbon fiber composite material so that the diameter of the inner contacting surface 58 is equal to the diameter of the outer surface 45 of the mandrel 40, whereupon if necessary a very fine abrasive can be used against the inner contacting surface 58 to remove only enough material from the inner contacting surface 58 until the inner contacting surface 58 easily slides over the outer surface 45 of the mandrel 40 during mounting and dismounting of the bridge sleeve 30 onto and from the mandrel 40.

Figure 11:
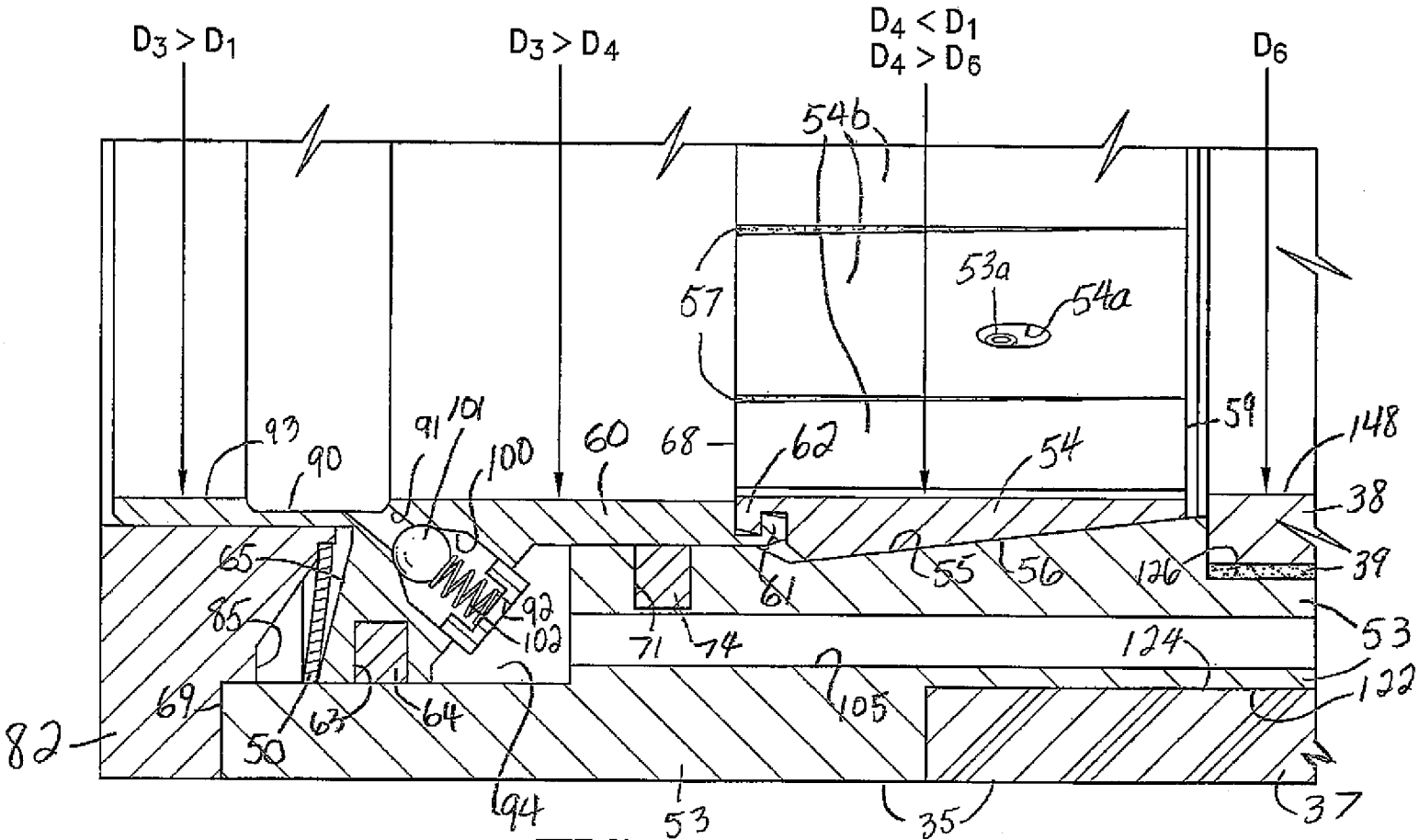
FIG. 11 schematically illustrates an enlarged cross-sectional view (taken along the sight arrows designated 11-11 in FIG. 5) of part of the operator end of the embodiment of the bridge sleeve shown in FIG. 7A, before the pressurized air is introduced into the stabilizers.

As shown in FIGS. 3 and 11 for example, the inner shell 54 is defined in part by a section that has conically shaped surface 56. As shown in FIG. 3 for example, the opposite the conically shaped surface 56, the inner shell 54 defines a cylindrically shaped surface that is the inner contacting surface 58 of the inner shell 54. As shown in FIG. 11 for example, there is a tongue and groove surface 61 on the exterior of one end 68 of the inner shell 54. As shown in FIGS. 3 and 4 for example, the inner shell 54 of each of the stabilizers 51, 52 desirably is composed of a plurality of sections 54*b* that are joined together at adjacent axially extending edges with an elastic adhesive such as a polymeric adhesive. The MERBENIT brand permanently elastic adhesive and sealant available from Antala Industria, S.L. of Barcelona, Spain provides a suitable polymeric adhesive for connecting the individual steel sections 54*b* that once joined together form the inner shell 54. The distance between each pair of the adjacent axially extending edges of the separate sections 54*b* of the inner shell 54 defines a slot 57 that is filled with the elastic adhesive that connects the adjacent sections 54*b* of the inner shell 54. Each slot 57 between the adjacent sections 54*b* comprising the inner shell 54 desirably extends the entire axial length of the inner shell 54. Given the dimensions of an inner shell 54 that is serviceable for bridge sleeves 30 suitable for a large percentage of printing machines now in use, the inner shell 54 desirably comprises twenty sections 54*b* of equal size. However, it also is possible to use ten sections that are formed so that each section is twice the size in the circumferential direction as one of the twenty sections 54*b* and is divided by a central slot 57 that does not pass completely through the centerline of the ten section embodiment and ends at the tongue and groove surface 61 of the inner shell 54. In the ten section embodiment, the elastic adhesive fills the central slot as well as the slots 57 between each of the adjacent ten sections. In any case, any excess elastic adhesive is removed so that both the conical surface 56 and the inner contacting surface 58 of the inner shell 54 are smooth.

Figure 9:
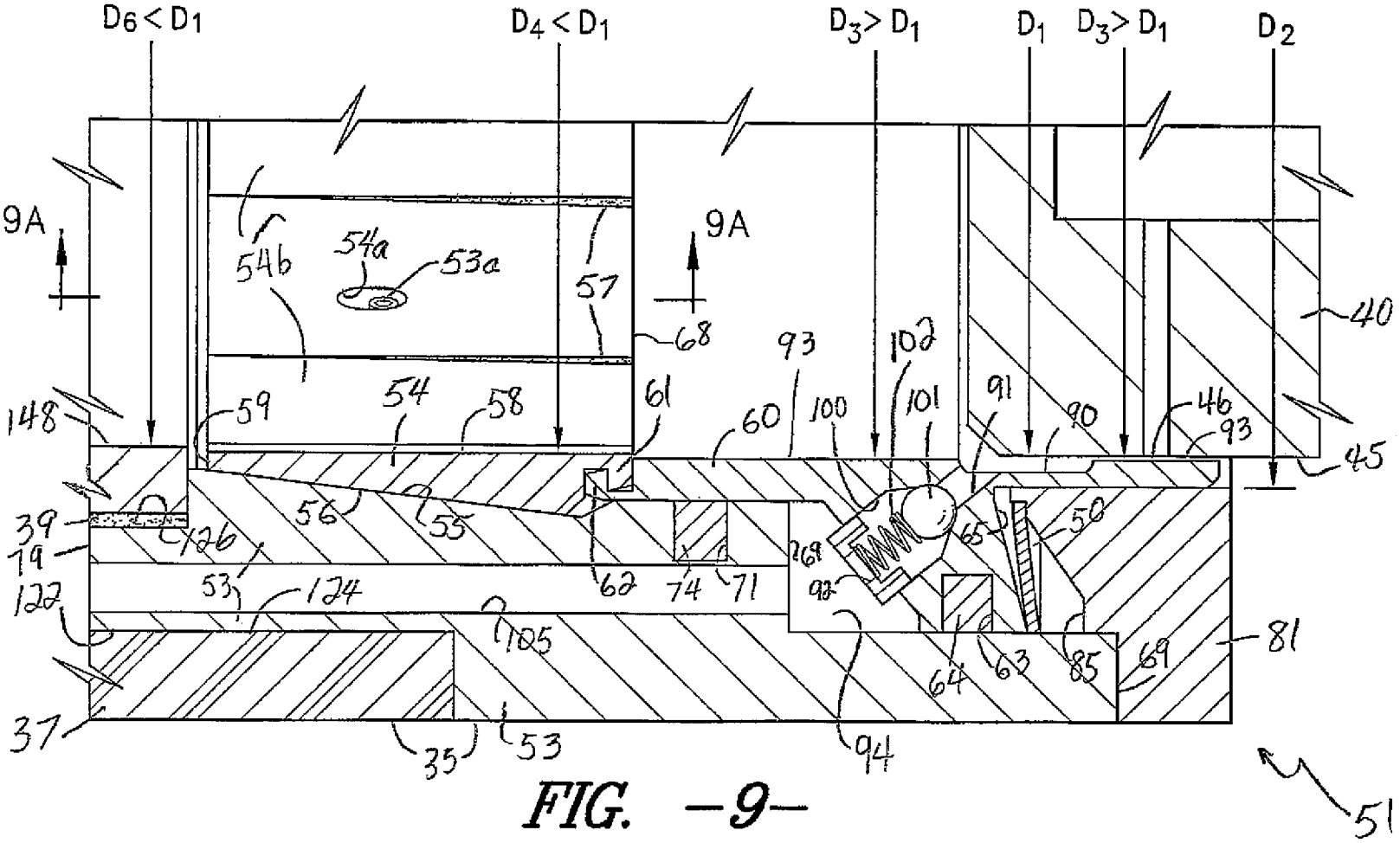
FIG. 9 schematically illustrates an enlarged cross-sectional view of part of the motor end of the embodiment of the bridge sleeve shown in FIG. 7A, before the pressurized air is introduced into the stabilizers.
Figure 9A:
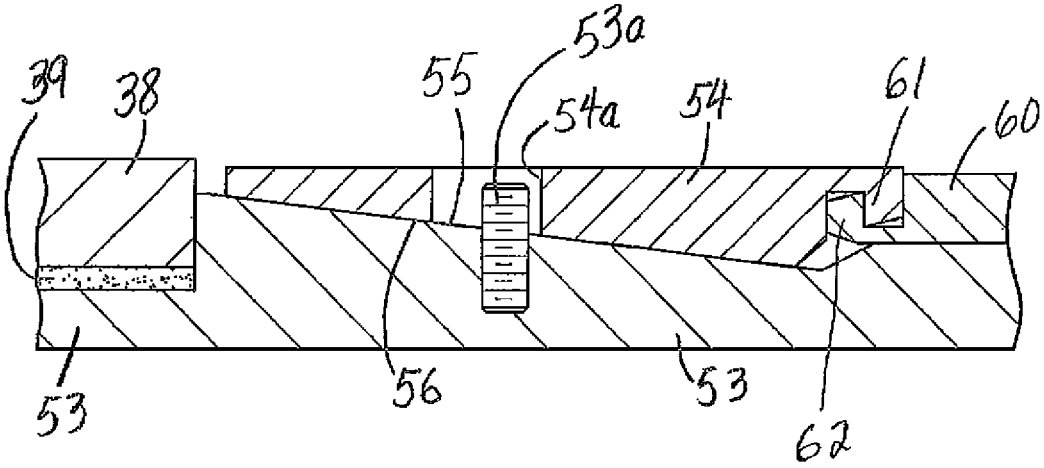
FIG. 9A schematically illustrates an enlarged cross-sectional view (taken along the sight arrows designated 9A-9A in FIG. 9) of part of components of the stabilizers of an embodiment of the bridge sleeve of the present invention.

As shown in FIGS. 4, 9, 9A and 10 for example, each inner shell 54 has defined through one of its sections, an oblong opening 54*a* that has the longer dimension of the oblong opening 54*a* oriented parallel to the axial center line 30*a* (FIG. 2) of the bridge sleeve 30. As shown in FIG. 9A for example, projecting radially outwardly from the inner surface 55 of the outer shell 53 is a set screw 53*a* that projects up into the oblong opening 54*a* and acts as a guide for the axial movement of the inner shell 54 relative to the outer shell 53. The set screw 53*a* also could be positioned to project in a direction that was normal to the inner conical surface 55 of the inner shell. The set screw 53*a* desirably can have one threaded end that can be screwed into a threaded hole defined in the outer shell 53. The sizing, shape and orientation of the oblong opening 54*a* constrains the movement of the inner shell 54 relative to the outer shell 53 when the set screw 53*a* is surrounded by the oblong opening 54*a*.

In an embodiment depicted in FIGS. 9 and 11 for example, the outer shell 53 is fixed with respect to the rigid outermost layer 37 of the bridge sleeve 30. As shown in FIG. 9 for example, the recessed outer surface 122 of the outer shell 53 can be connected to the inner cylindrical surface 124 of the rigid carbon fiber outer layer 37. In the embodiments shown in FIGS. 9 and 11 the inwardly facing end of the outer shell 53 is shown to be directly connected (as by adhesive) to one end of the cylindrical rigid outer cylindrical layer 37 of the bridge sleeve 30. Thus, the outer shell 53 is sometimes referred to as the rigid holder body or the main body because it rigidly carries and holds one end of the rigid outermost layer 37 of the bridge sleeve 30. In an embodiment depicted in FIGS. 9 and 11 for example, the outermost cylindrical surface 35 of the outer shell 53 desirably is co-extensive with the cylindrical outer surface 35 of the rigid outermost layer 37 of the bridge sleeve 30 to form the outer surface 35 of the bridge sleeve 30.

Likewise, each outer shell 53 desirably is permanently connected (as by adhesive) to one end of the radially expandable cylindrical inner core 38 of the bridge sleeve 30. As shown in FIGS. 9 and 11 for example, a compressible layer 39 desirably is disposed between the end of the outer surface of the inner core 38 and the recessed inner surface 126 of the outer shell 53 of each stabilizer 51, 52. As shown in FIGS. 3 and 4 for example, the outer shell 53 defines an axially extending inner cavity that is partially defined by a rigid inner surface with a section defining an inner conical surface 55. As shown in FIGS. 9 and 11 for example, the inner conical surface 55 of the outer shell 53 desirably has a diameter that increases as one moves inwardly away from the end of the outer shell 53 where the outer shell 53 is connected to the radially expandable inner core 38 of the bridge sleeve 30.

Unlike the outer shell 53, the inner shell 54 of each stabilizer 51, 52 is not fixed with respect to either of the inner core 38 or the rigid outer layer 37 of the bridge sleeve 30. Nor is the inner shell 54 of each stabilizer 51, 52 fixed with respect to the outer shell 53. As shown in FIGS. 9 and 11 for example, the inner shell 54 is defined in part by a section that has conically shaped surface 56 in a manner that complements the shape of the inner conical surface 55 of the outer shell 53 and is disposed to butt and slide against the inner conical surface 55 of the outer shell 53. Thus, the outer conical surface 56 of the inner shell 54 of each stabilizer 51, 52 nests within the inner conical surface 55 of the outer shell 53 and thus is axially, moveably received within the respective axially extending inner cavity of the respective rigid outer shell 53.

As shown in FIGS. 9 and 10 for example, the section of the inner shell 54 that has the conical outer surface 56 defines a plurality of slots 57 that extend completely through the inner shell 54 from the conical surface 56 through the inner contacting surface 58 that defines a portion of the inner bore that extends axially completely through the bridge sleeve 30. In the embodiments shown in FIGS. 9 and 10 for example, each slot 57 extends axially from the inward-facing edge 59 of the inner shell 54 that defines the narrower free end of the conical surface 56 and desirably extends completely through the opposite edge 68. However, as described above, all but one of the slots 57 desirably are filled with elastic adhesive, and one slot 57 is left unfilled for purposes of facilitating installation of the inner shell 54 into the outer shell 53 during assembly of the stabilizers 51, 52.

In the embodiments shown in FIG. 11 for example, there is a tongue and groove surface 61 on the exterior of one end 68 of the inner shell 54. This tongue and groove surface 61 receives a complementary tongue and groove surface 62 on the interior surface of an annular piston 60 so that the annular piston 60 can be connected onto the inner shell 54 and mechanically attached thereto to form a combined integral structure. However, the two tongue and groove surfaces 61, 62 are joined in a slip fit that permits some small relative movement in the radial direction between the inner shell 54 and the annular piston 60, but little if any axial relative movement between the inner shell 54 and the annular piston 60. Thus, axial movement of the annular piston 60 necessarily drags the inner shell 54 axially in the same direction as the axial movement of the annular piston 60 and vice-versa. But the inner shell 54 can move slightly in the radial direction while the annular piston 60 does not move with the inner shell 54 in the radial direction.

Each annular piston 60 desirably is formed of 90 kg drawn steel sheet that has been tempered. In the embodiments shown in FIGS. 9, 10, 11, 12 and 20 for example, each annular piston 60 desirably is provided with an air capture groove 90 extending circumferentially around the entire annular piston 60 and beneath the inner surface 93 thereof at the end of the annular piston 60 opposite where the tongue and groove surface 62 is configured. As shown in FIGS. 9 and 11 for example, a circumferential groove 63 is configured in the exterior surface of the annular piston 60 that faces an opposing surface of the outer shell 53. As shown in FIGS. 3, 4, 9 and 11 for example, this circumferential groove 63 is configured to receive a pressure sealing ring 64. This pressure sealing ring 64 is desirably formed from a combination of rubber as in a conventional pressure sealing O-ring and material such as polytetrafluoroethylene that lends some rigidity to the ring 64, which is not radially deformable when supported in the circumferential groove 63. As shown in FIGS. 9 and 11 for example the pressure sealing ring 64 has a square transverse shape. This pressure sealing ring 64 creates a seal against the escape of air past where the pressure sealing ring 64 slides against a first opposing surface of the outer shell 53.

As shown in FIGS. 3, 4, 9 and 11 for example, there is a circumferentially extending groove 71 with a square-shaped transverse cross-section 71 defined in the interior section of the outer shell 53. This circumferential groove 71 is disposed adjacent where the annular piston 60 contacts the outer shell 53 and receives a complementarily shaped pressure sealing ring 74 having a smaller diameter but otherwise like the pressure sealing ring 64 described above. This pressure sealing ring 74 similarly creates a seal against the escape of air past where the pressure sealing ring 74 slides against an exterior surface of the annular piston 60.

In the embodiments shown in FIGS. 3, 4, 9 and 11 for example, each of the stabilizers 51, 52 desirably includes a resiliently flexible biasing member, such as a flat ring spring 50, and a respective end cap 81, 82, which desirably is formed as an annular ring member. In the embodiments shown in FIGS. 4 and 9 for example, a motor end cap 81 forms part of the motor end stabilizer 51, while as similarly shown in FIGS. 3 and 11 for example, an operator end cap 82 forms part of the operator end stabilizer 52. As shown in FIG. 13D for example, the registration notch 31 is defined in a portion of the inner surface of the motor end cap 81. As shown in FIGS. 3, 4, 5 and 6 for example, each of the end caps 81, 82 is rigidly connected to its respective outer shell 53 by a plurality of threaded bolts 80. As shown in FIG. 13C for example, the threaded end of each bolt 80 passes through a bore 83 that extends axially through the respective end cap 81, 82 and into a threaded hole 84 defined axially into the outwardly facing free edge 69 of the outer shell 53 so that the respective end cap 81, 82 can be bolted onto the outer shell 53 and mechanically attached thereto to form a combined integral structure. Thus, once bolted to the outer shell 53, the respective end cap 81, 82 necessarily remains fixed in position with respect to the outer shell 53 and provides a backstop against axial movement of inner circumferential end of the flat ring spring 50.

Figure 12:
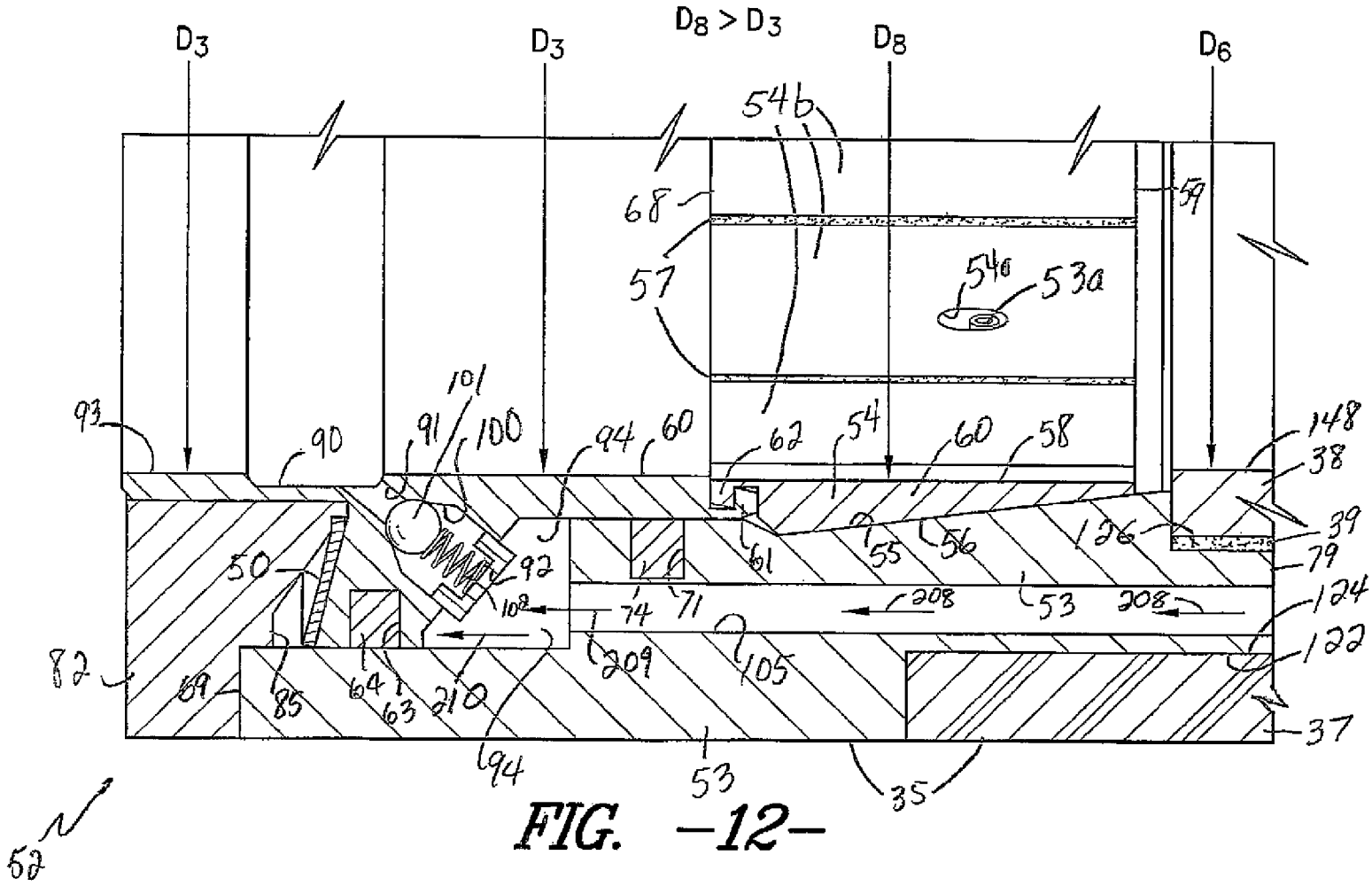
FIG. 12 schematically illustrates an enlarged cross-sectional view of part of the operator end of the embodiment of the bridge sleeve shown in FIG. 8A, after the pressurized air is introduced into the stabilizers.

As shown in FIGS. 9 and 11 for example, the flat ring spring 50 is disposed in an annular space that is defined between the inwardly facing end 85 of the respective end cap 81, 82 and the outwardly facing side 65 of the respective annular piston 60. The flat ring spring 50 thus tends to bias the annular piston 60 and integrally connected inner shell 54 in the axial direction toward the axial center of the bridge sleeve 30 so that the conical surface 56 of the inner shell 54 slides against the conical surface 55 of the outer shell 53. Because each outer shell 53 remains immovable with respect to its respective end cap 81, 82, the slots 57 of the inner shell 54 must narrow to accommodate the axial movement of the inner shell 54 away from the flat ring spring 50 and toward the conical surface 55 of the outer shell 53 with the result that the diameter of the inner contacting surface 58 of the inner shell 54 becomes diminished. The normal gap between the opposed walls defining each of the slots 57 of the inner shell 54 in an unstressed state is depicted in FIGS. 10 and 12 for example. However, the relatively narrowed gap between the opposed walls defining each of the slots 57 of the inner shell 54 is depicted in FIGS. 9 and 11.

The assembly of each of the stabilizers 51, 52 proceeds in the same fashion, which now will be described, and desirably precedes the attachment of the radially expandable cylindrical inner core 38 and the rigid outermost layer 37 to the two stabilizers 51, 52 of the bridge sleeve 30. Referring to FIGS. 4 and 9 for example, assembly of the embodiment of the first stabilizer 51 depicted therein proceeds by initially installing the pressure sealing ring 74 into the groove 71 in the outer shell 53. The pressure sealing ring 64 is inserted into the groove 63 in the annular piston 60. Leading with the tongue and groove surface 62 on the interior surface of the annular piston 60, the annular piston 60 is inserted into the outer shell 53 from the outwardly facing free edge 69 of the outer shell 53. Then the flat ring spring 50 is placed against the outwardly facing side 65 of the annular piston 60, and the end cap 81 is bolted onto the outwardly facing free edge 69 of the outer shell 53 to back stop the flat ring spring 50 that biases the axial position of the annular piston 60 toward the center of the bridge sleeve 30. The sections 54*b* of the inner shell 54 are glued together except for the last two opposing edges, which are left unattached so that the inner shell 54 can be inserted into the outer shell 53 from the inwardly facing free edge 79 of the outer shell 53. The inner shell 54 is inserted into the outer shell 53 leading with the tongue and groove surface 61 on one end of the inner shell 54. The tongue and groove surface 61 of the inner shell 54 is hooked into the complementary tongue and groove surface 62 on the interior of the annular piston 60. The inner shell 54 and annular piston 60 are rotated so that the oblong opening 54*a* through the inner shell 54 is aligned with the threaded opening through the outer shell 53 that receives the set screw 53*a*. Whereupon the set screw 53*a* is screwed into the threaded opening in the outer shell 53 from within the inner shell 54. Now the two complementarily shaped conical surfaces 55, 56 of the respective shells 53, 54 touch one another.

Figure 7B:
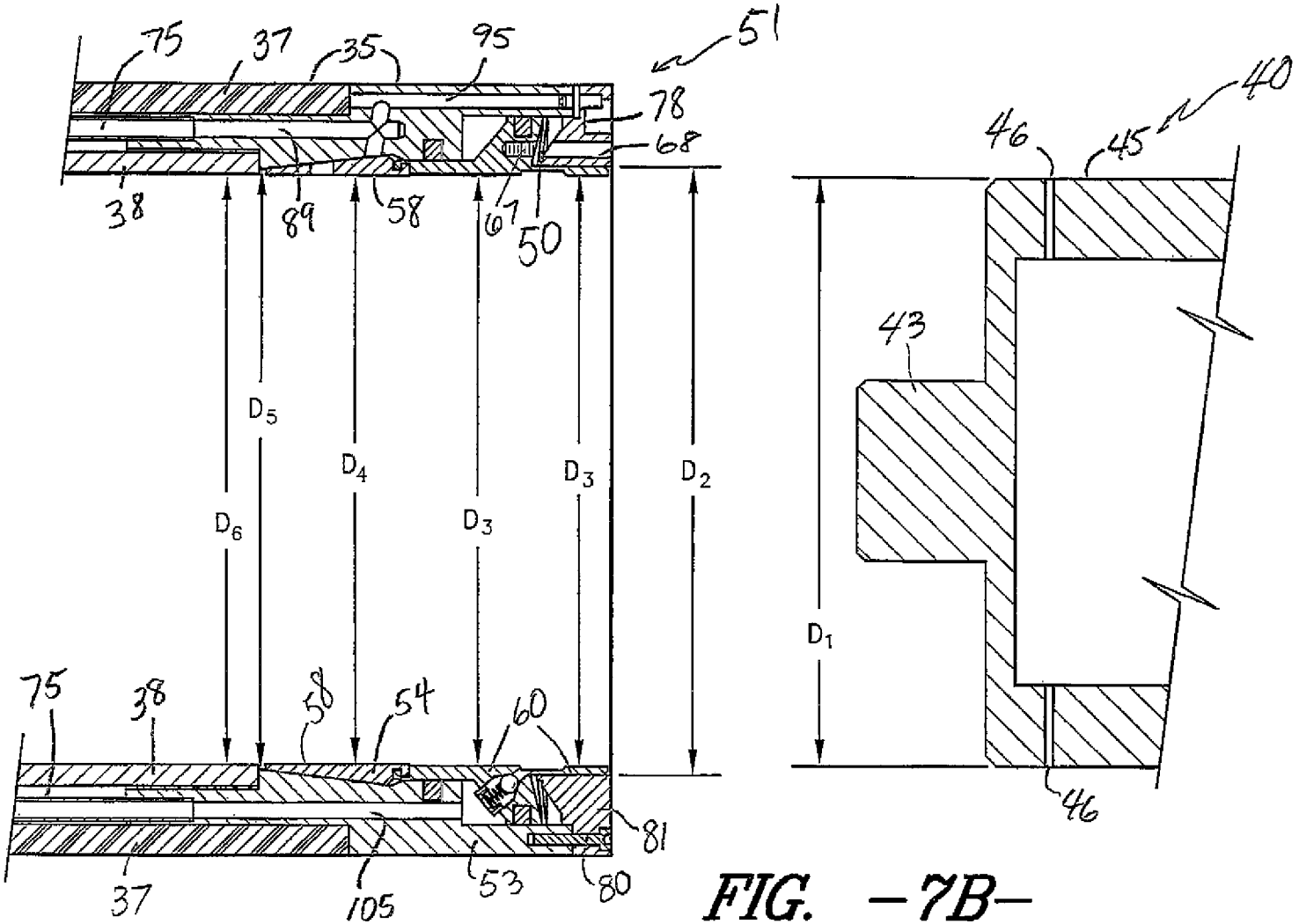
FIG. 7B schematically represents a cross-sectional view of an inventive embodiment of a motor end of a bridge sleeve showing various relative diametric dimensions in relation to the outside diameter of the mandrel before the pressurized air is introduced into the stabilizers.

As schematically shown in FIGS. 7A and 7B, because the diameter schematically designated D3 of the inner surface 93 of annular piston 60 is larger than the diameter of the outer surface 45 of the mandrel 40 schematically designated D1, it is possible for the operator to slide enough of the motor end of the bridge sleeve 30 onto the operator end of the mandrel 40 so that the air pressure holes 46 in the outer surface 45 of the mandrel 40 reach the air capture groove 90 of the annular piston 60 in the motor end stabilizer 51.

Figure 8B:
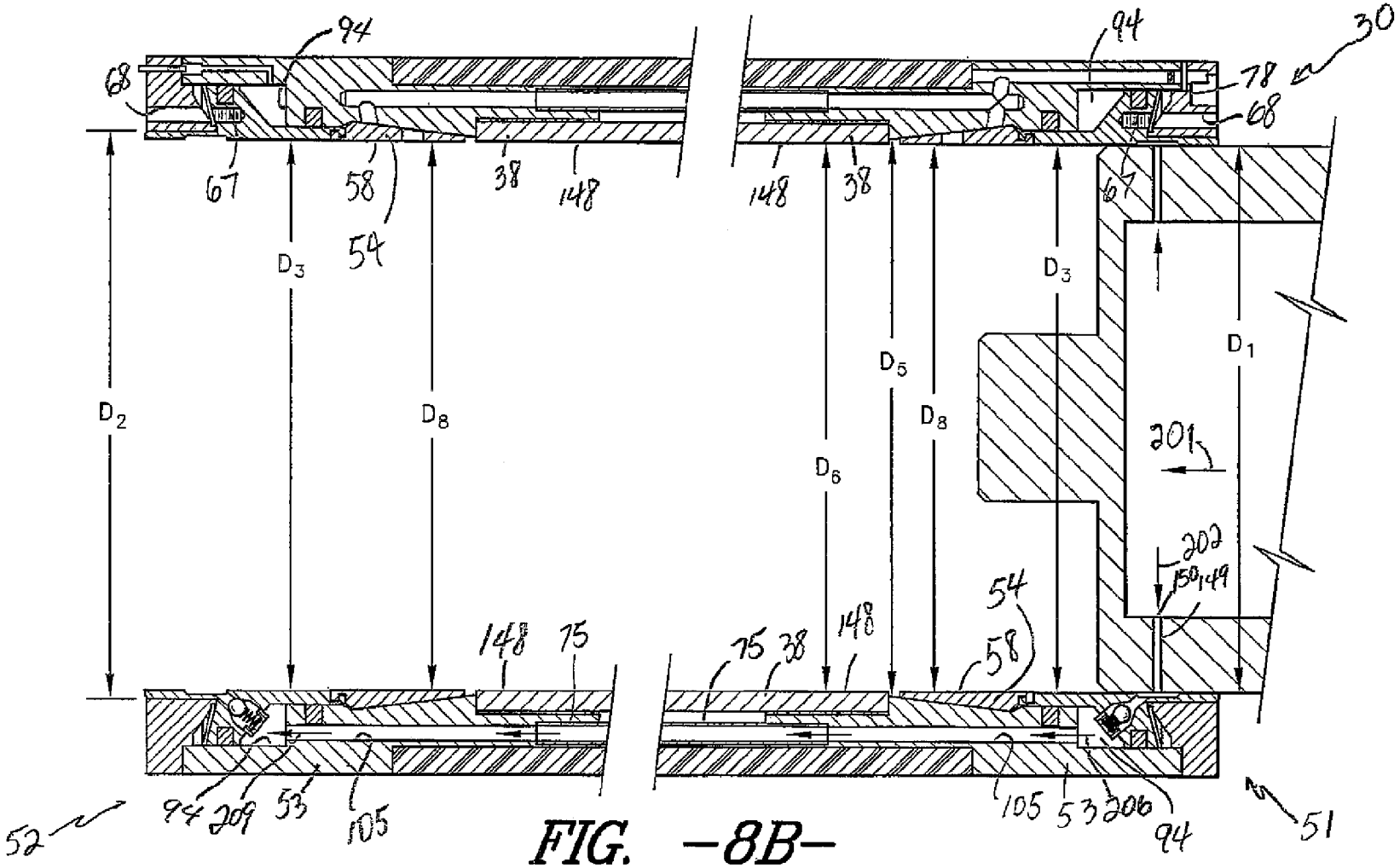
FIG. 8B schematically represents a cross-sectional view of an inventive embodiment of a bridge sleeve (broken in the middle) showing various relative diametric dimensions in relation to the outside diameter of the mandrel after the pressurized air is introduced into the stabilizers to expand the inner diameter thereof larger than the outside diameter of the mandrel.

The bridge sleeve 30 desirably includes a pressurized air circuit that receives pressurized air from a source outside of the bridge sleeve 30 and is configured to actuate the expansion mechanisms that expand the diameter of the inner contacting surface 58 of the inner shell 54 of each of the stabilizers 51, 52 so that the bridge sleeve 30 alternately can be air-mounted onto or removed from the mandrel 40. The air capture grooves 90 of the annular pistons 60 of the stabilizers 51, 52 form the entrance openings to the pressurized air circuit that receives pressurized air from a source outside of the bridge sleeve 30 to actuate the stabilizers 51, 52. Each of FIGS. 7A and 7B depicts a cross-sectional view of the motor end of a bridge sleeve 30 positioned before reaching the entrance opening 90 to the pressurized air circuit that actuates the diametric variation of the inner contacting surfaces 58 of the inner shells 54 of the stabilizers 51, 52 becomes positioned in communication with the air holes 46 through the outer surface 45 at the operator end of the mandrel 40. Each of FIGS. 8A and 8B depicts a cross-sectional view of the motor end of a bridge sleeve 30 while the entrance opening to the pressurized air circuit that actuates the diametric variation of the inner contacting surfaces 58 of the inner shells 54 of the stabilizers 51, 52 becomes positioned in communication with the air holes 46 through the outer surface 45 at the operator end of the mandrel 40 while the pressurized air is being supplied through the mandrel 40 to the air holes 46.

Each of FIGS. 9 and 11 is an enlarged detailed view of part of the motor end and operator end respectively, taken from FIG. 7A at a time just before the pressurized air is supplied through the mandrel 40. In FIG. 1 for example, the arrow designated 200*a* schematically illustrates the direction in which the bridge sleeve 30 is being moved onto the stationary mandrel 40 by an operator. As shown in each of FIG. 9, the air capture groove 90 formed in the inner surface 93 of the annular piston 60 has not yet aligned with the air pressure holes 46 in the outer surface 45 of the mandrel 40. Note that in the operational state depicted in FIGS. 9 and 11, the flat ring spring 50 is configured at its minimal state of compression so that the axial distance between the inwardly facing end 85 of the end cap 81 and the outwardly facing side 65 of the annular piston 60 is at its maximum distance. As shown in FIG. 9, the diameter of the inner surface 93 of the annular piston 60 is wide enough so that the gap that exists between the outer surface 45 of the mandrel 40 and the inner surface 93. This gap permits enough clearance so that the inner surface 93 of the annular piston 60 slides easily over the outer surface 45 of the mandrel 40 for a distance that is sufficient to enable the operator to position the air capture groove 90 directly in alignment with the air pressure holes 46 in the outer surface 45 of the mandrel 40.

As shown in FIG. 9, the annular piston 60 of the first stabilizer 51 at the motor end of the bridge sleeve 30 defines an internal valve chamber 100 that has one end in fluid communication with an exit opening 92. The exit opening 92 is in fluid communication with and empties into an air pressure plenum 94 that is defined between the annular piston 60 and the outer shell 53 and extends circumferentially around the entire first stabilizer 51. The opposite end of the internal valve chamber 100 is conically shaped with the narrowest diameter portion in direct fluid communication with the air capture groove 90 through an angled entrance passage 91. Furthermore, a one-way valve is disposed within this internal valve chamber 100. The one-way valve is configured to admit air into the internal valve chamber 100 and the air pressure plenum 94 and prevent escape of air from the internal valve chamber 100 and the air pressure plenum 94. As schematically shown in FIG. 9, the one-way valve desirably can be provided in the form of a check valve that has a ball 101 and a spring 102, which biases the ball 101 against a relatively narrower diameter portion of the conically shaped end of the internal valve chamber 100. The one-way valve permits pressurized air to enter the internal valve chamber 100 from the air holes 46 in the surface 45 of the mandrel 40 via the angled entrance passage 91, but prevents escape of that pressurized air once it has passed the ball 101.

As shown in FIGS. 9 and 11 for example, the pressurized air circuit for actuating the expansion mechanisms that expand the diameter of the inner contacting surface 58 of the inner shell 54 of each of the stabilizers 51, 52 desirably includes at least one outer axial conduit 105 (e.g., FIGS. 4 and 9) that is formed in the outer shell 53. As shown in FIG. 9 for example, each outer axial conduit 105 is defined by a cylindrical passage that extends axially through the outer shell 53 and terminates at each opposite end through either the outwardly facing free edge 69 or the inwardly facing free edge 79 of the outer shell 53. As schematically shown in FIG. 4 for example, the pressurized air circuit further desirably includes three outer axial conduits 105 that extend axially into the outer shell 53. Each of the three outer axial conduits 105 is circumferentially spaced 120 degrees from each of the other two outer axial conduits 105. As schematically shown in FIG. 7A for example, a respective one of each of the outer axial conduits 105 of the first stabilizer 51 is connected via an axially extending hollow tube 75 in relatively air-tight fluid communication to a respective one of the outer axial conduits 105 of the second stabilizer 52. In this way, pressurized air entering the internal valve chamber 100 and the air pressure plenum 94 of the first stabilizer 51 is transported and distributed into the internal valve chamber 100 and the air pressure plenum 94 of the second stabilizer 52, and vice versa.

Thus, the pressurized air circuit for actuating the expansion mechanisms that expand the diameter of the inner contacting surface 58 of the inner shell 54 of each of the stabilizers 51, 52 includes a continuous air flow path that includes the air capture groove 90 of the annular piston 60, the angled entrance passage 91 defined in the annular piston 60, the internal valve chamber 100 defined in the annular piston 60, the check valve disposed in the internal valve chamber 100, the circumferentially extending air pressure plenum 94 defined between annular piston 60 and outer shell 53, the three the outer axial conduits 105 defined in the outer shells of the stabilizers, 51, 52 and the three axially extending hollow tube 75 extending between the first and second stabilizers, 51, 52.

The cross-sectional views shown in FIGS. 10 and 12 are enlarged sections of the view in FIG. 8A, which schematically depicts the pressurized air having actuated the pressurized air circuit of the bridge sleeve 30 in order to increase the diameter of the inner contacting surface 58 of the inner shell 54 of the first stabilizer 51 at the motor end of the bridge sleeve 30 and the second stabilizer 52 at the operator end of the bridge sleeve 30. In this manner, each of the plurality of slots 57 through the inner shell 54 has attained its maximum circumferential distance between the opposed sides that form these slots 57 such that each respective circumferential gap is uniform for the entire axial length of each of the axially extending slots 57.

Figure 18:
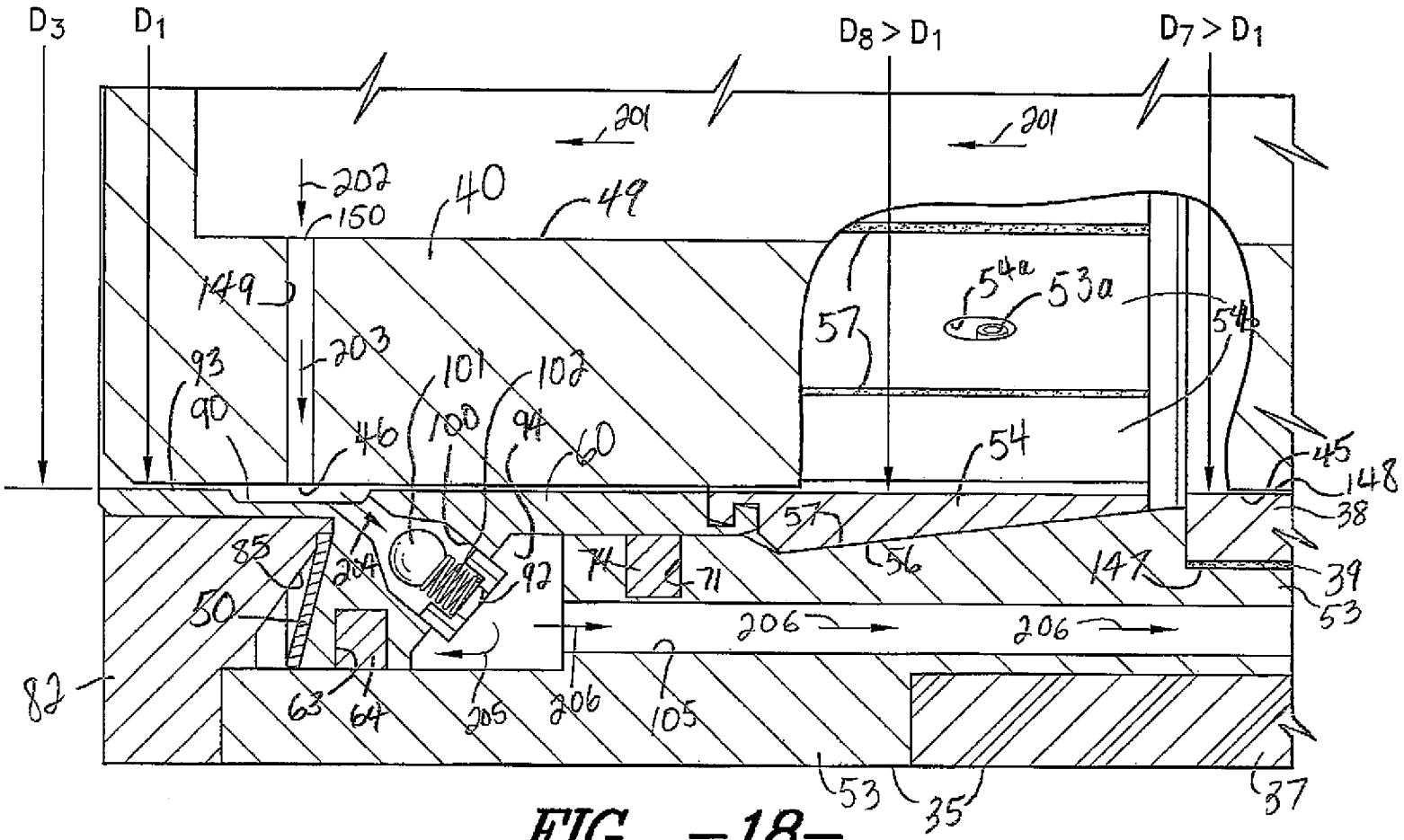
FIG. 18 schematically illustrates an enlarged cross-sectional view of part of the operator end of the embodiment of the bridge sleeve shown in FIG. 14, after the pressurized air is introduced into the stabilizers and develops an air bearing beneath the inner core so that the bridge sleeve can be removed from the mandrel.

As shown in FIGS. 10 and 18 for example, pressurized air can be supplied through the operator end of the mandrel 40 to the holes 46 in the outer surface 45 of the mandrel 40 via an axially extending central bore 49 from which radially extending bores 149 branch off as the spokes to a bicycle rim via holes 150 that form the entrances of each of the radial bores 149. Each of the air holes 46 formed through the outer surface 45 of the mandrel 40 forms the exit opening of one of the radial bores 149.

The arrows designated 201 in FIGS. 8A, 8B and 10 schematically represent the pressurized air traveling through the axially extending central bore 49 of the operator end of the mandrel 40. The arrows designated 202 in FIGS. 8A, 8B and 10 schematically represent the pressurized air traveling from the axially extending central bore 49 of the operator end of the mandrel 40 and into the radially extending bores 149 via the holes 150 that form the entrances of each of the radial bores 149 of the operator end of the mandrel 40. The arrow designated 203 in FIG. 10 schematically represents the pressurized air traveling through the radially extending bores 149 of the operator end of the mandrel 40 to the holes 46 through the outer surface 45 of the mandrel 40.

As schematically shown in FIG. 10 by the arrow 204, upon exiting the holes 46 through the outer surface 45 of the mandrel 40, the pressurized air fills the air capture groove 90 of the annular piston 60 and passes into the angled entrance passage 91 that leads away from the air capture groove 90. The pressurized air then leaves the entrance passage 91 and pushes past the one way valve to enter the internal valve chamber 100 of the annular piston 60. As schematically shown in FIG. 10 by the arrow 205, the pressurized air leaves the internal valve chamber 100 via the exit opening 92 and passes into the air pressure plenum 94 defined between annular piston 60 and outer shell 53. The pressure sealing rings 64, 74 ensure retention of the pressurized air in the pressurized air circuit of the bridge sleeve 30.

As schematically shown in FIGS. 8A and 10 by the arrow designated 206, the pressurized air that fills the air pressure plenum 94 also enters the axial air passage 105 formed in the outer shell 53. As schematically shown in FIG. 8A by the arrow 207, the pressurized air that leaves the axial air passage 105 formed in the outer shell 53 of the motor end stabilizer 51 travels via the axially extending hollow tube 75 to the operator end stabilizer 52. As schematically shown in FIGS. 8A and 12 by the arrows designated 208, the pressurized air that has traveled via the axially extending hollow tube 75 to the operator end stabilizer 52 enters the axial air passage 105 formed in the outer shell 53 of the operator end stabilizer 52. As schematically shown in FIG. 12 by the arrow 209, the pressurized air leaves the axial air passage 105 formed in the outer shell 53 of the operator end stabilizer 52 and enters the air pressure plenum 94 defined between annular piston 60 and the outer shell 53 of the operator end stabilizer 52. However, due to the configuration and orientation of the one-way valve disposed in the internal valve chamber 100 of the annular piston 60 of the operator end stabilizer 52, pressurized air entering the internal valve chamber 100 via the exit opening 92 cannot escape via the angled entrance passage 91 in the annular piston 60 of the operator end stabilizer 52 and so remains in the air pressure plenum 94.

As schematically shown by the arrow designated 205 in FIG. 10 and the arrow designated 210 in FIG. 12, the pressurized air filling the respective air pressure plenums 94 pushes against the tension in the respective springs 50 and axially translates the respective annular pistons 60 toward the respective end cap 81, 82. Because each inner shell 54 is integrally connected to the its respective annular piston 60, movement of the annular pistons 60 toward the respective annular end caps 81, 82 results in commensurate movements of the respective inner shells 54 toward the respective annular end caps 81, 82. Such movements result in the expansion of the diameters of the inner contacting surfaces 58 of the inner shells 54 from the diameter schematically designated D4 in FIG. 7B to the diameter schematically designated D8 in FIG. 8B. The diameter of the inner contacting surfaces 58 of the inner shells 54 schematically designated D4 in FIG. 7B is smaller than the diameter of the outer surface 45 of the mandrel 40 schematically designated D1 in FIG. 7B. However, the diameter of the inner contacting surfaces 58 of the inner shells 54 schematically designated D8 in FIG. 8B is larger than the diameter of the outer surface 45 of the mandrel 40 schematically designated D1 in FIG. 8B.

When relieved of the radially inwardly-directed compressive contact imposed by the conical surface 55 of the outer shell 53, the circumferential gaps that define the axial slots 57 in the inner shell 54 are free to expand circumferentially to their maximum circumferential extents as schematically shown in FIGS. 3, 4, 8A, 10 and 12 for example. When the axial slots 57 in the inner shell 54 are free to expand circumferentially to their maximum circumferential extents as shown in FIGS. 3, 4, 8A, 10 and 12 for example, the diameter D8 of the inner contacting surfaces 58 of the inner shells 54 becomes large enough to provide a clearance gap between the inner contacting surfaces 58 and the outer surface 45 of the mandrel 40 as schematically depicted in FIG. 10 for example. Thus, the diameters D8 of the inner contacting surfaces 58 of the stabilizers 51, 52 are expanded sufficiently so as to avoid contact with the outer surface 45 of the mandrel 40, and this contact avoidance allows the bridge sleeve 30 to be mounted onto and/or dismounted from the outer surface 45 of the mandrel 40.

With the inner contacting surfaces 58 of the inner shells 54 of the stabilizers 51, 52 expanded sufficiently to slide over the outer surface 45 of the mandrel 40, the bridge sleeve 30 can be advanced onto the mandrel 40 sufficiently toward the registration pin 44 to enable the pressurized air exiting the holes 46 through the outer surface 45 of the mandrel 40 to expand the inner surface 148 of the inner core 38 of the bridge sleeve 30 sufficiently to allow the operator to slide the bridge sleeve 30 onto the mandrel and become properly positioned with the registration notch 31 engaging the registration pin 44 as schematically shown in FIG. 13D for example. Once the bridge sleeve 30 has attained the desired position on the mandrel 40, the operator can turn off the pressurized air from the mandrel 40 and allow the inner surface 148 of the inner core 38 of the bridge sleeve 30 to contract and tightly grip the outer surface 45 of the mandrel 40.

In order to deploy the inner contacting surfaces 58 of the inner shells 54 of the stabilizers 51, 52 into direct contact with the outer surface 45 of the mandrel, it is necessary to release the pressurized air from the pressurizing air circuit of the bridge sleeve 30. The release of the pressurized air within this circuit frees the flat ring springs 50 to apply forces that effect a sufficient reduction of the diameters of the inner contacting surfaces 58 that place the inner contacting surfaces 58 into contact with the outer surface 45 of the mandrel 40. The diameter of the inner contacting surface 58 of the inner shell 54 becomes reduced until it matches the outer diameter D1 of the outer surface 45 of the mandrel 40. Thus, as schematically shown in FIG. 13B for example, the diameters D1 of the inner contacting surfaces 58 of the stabilizers 51, 52 become sufficiently contracted so as to come into contact with the outer surface 45 of the mandrel 40, and this contact allows the bridge sleeve 30 to be maintain rigid, positive direct contact between the outer surface 45 of the mandrel 40 and the outer surface 35 of the bridge sleeve 30. It is this rigid uninterrupted contact between the outer surface 45 of the mandrel 40 and the outer surface 35 of the bridge sleeve 30 that enables the print sleeve 41 to avoid the type of instability that results in the types of print deterioration described above in the background.

As schematically shown in FIGS. 1, 2 and 13A for example, releasing the pressurized air from the pressurizing air circuit desirably can be accomplished by the operator pressing the actuating pin 86 projecting from the operator annular end cap 82. As schematically shown in FIG. 13A for example, this actuating pin 86 opens a release valve 87 disposed in the operator annular end cap 82 and in fluid communication with the pressurized air circuit via a release passage 88 defined in the outer shell 53 of the operator stabilizer 52. As schematically shown in FIG. 13A for example, the release passage 88 defined in the outer shell 53 of the operator stabilizer 52 is in fluid communication with the air pressure plenum 94 defined between annular piston 60 and the outer shell 53 of the operator stabilizer 52. Moreover, the air pressure plenum 94 of the operator stabilizer 52 is in fluid communication with the air pressure plenum 94 of the motor stabilizer 51 via the three axially extending hollow tubes 75 extending between the first stabilizer 51 and the second stabilizer 52.

The flat ring spring 50 in each stabilizer 51, 52 provides the biasing force that keeps the inner contacting surface 58 of the inner shell 54 of each stabilizer 51, 52 firmly in contact with the outer surface 45 of the mandrel 40 and the conical surface 56 of the inner shell 54 firmly in contact with the conical surface 55 of the outer shell 53. The force constant that characterizes each flat ring spring 50 desirably should be large enough to overcome the centrifugal forces that are anticipated at the rotational speeds that can be attained by the outer surface 35 of the bridge sleeve 30 as it rotates with the mandrel 40 of the printing machine. Thus, the magnitude of these centrifugal forces will vary depending on the diameter of the outer surface 35 of the bridge sleeve 30. Accordingly, the force constant of the flat ring springs 50 will be selected to ensure sufficient biasing force to overcome these centrifugal forces and keep the stabilizers 51, 52 firmly in contact with the outer surface 45 of the mandrel 40 at the anticipated rotational speeds of the outer surface 35 of the bridge sleeve 30 as it rotates with the mandrel 40 that accommodates the line speed of the printable substrate through the printing machine.

Another consideration in the selection of the force constant of the flat ring springs 50 is the circumferentially directed force that occurs when the substrate that is being printed becomes involved in a so-called web wrap up event. The function of the stabilizers 51, 52 is not to lock the bridge sleeve 30 onto the outer surface 45 of the mandrel 40, as the locking function of the bridge sleeve 30 to the mandrel 40 is performed solely by the radially expandable cylindrical inner core 38. However, the force constant of the flat ring springs 50 desirably (but not necessarily) is selected so as to be overcome during the onset of a web wrap-up event so that marring of the outer surface 45 of the mandrel 40 by the inner contacting surface 58 of the inner shell 54 of each of the stabilizers 51, 52 might be avoided altogether or at least reduced insofar as the lengths and depths of the marring striations that otherwise might occur were the inner contacting surfaces 58 to remain in contact with the outer surface 45 of the mandrel 40 during a web wrap-up event.

The force constant of the flat ring springs 50 desirably (but not necessarily) can be selected so as to be overcome essentially instantaneously when the pressurized air is supplied to the pressurized air circuit of the bridge sleeve 30 via the holes 46 through the outer surface 45 of the mandrel 40. Thus, it becomes possible to outfit the printing machine with sensors that detect the onset of a web wrap up event and to program the operation of the printing machine so that when such sensors detect the onset of a web wrap up event, the pressurized air is automatically supplied to the holes 46 in the outer surface 45 of the mandrel 40. Then the inner contacting surfaces 58 of the inner shells 54 of the stabilizers 51, 52 quickly become expanded in diameter and retracted from contact with the outer surface 45 of the mandrel 40. In this way, it becomes possible to avoid (or at least reduce) marring of the outer surface 45 of the mandrel 40 by the inner contacting surfaces 58 of the inner shells 54 of each of the stabilizers 51, 52.

At some point it becomes necessary to remove the bridge sleeve 30 from the outer surface 45 of the mandrel 40 of the printing machine. FIG. 15 shows an enlarged view of parts of the motor end stabilizer 51 mounted on the mandrel 40. While FIG. 16 shows an enlarged view of parts of the operator end stabilizer 52 mounted on the mandrel 40. The process of removal involves first actuating the stabilizers 51, 52 to expand the inner contacting surfaces 58 until their diameters D8 are larger than the diameter D1 of the outer surface 45 of the mandrel 40. This is done in much the same way as the stabilizers 51, 52 were actuated when mounting the bridge sleeve 30 onto the mandrel 40. The supply 47 (FIG. 1) of pressurized air from the mandrel 40 is used to actuate the stabilizers 51, 52 of the bridge sleeve 30 so as to expand their inner contacting surfaces 58 sufficiently to remove their contact with the underlying outer surface 45 of the mandrel 40 and enable the bridge sleeve 30 to be slid off of the mandrel 40 while avoiding any metal-to-metal scraping that might otherwise damage the outer surface 45 of the mandrel 40 and damage the inner contacting surfaces 58 of the stabilizers 51, 52. However, during the process of removing the bridge sleeve 30 from the mandrel 40, the pressurized air that is expelled from the holes 46 in the operator end of the mandrel 40 is introduced into the pressurized air circuit of the bridge sleeve 30 via the air capture groove 90 of the annular piston 60 of the operator end stabilizer 52.

As schematically shown in FIGS. 13A and 16 for example, the air capture groove 90 of the annular piston 60 of the operator end stabilizer 52 is positioned in registry with the pressurized air delivery holes 46 through the outer surface 45 of the operator end of the mandrel 40. When the operator turns on the pressurized air from the supply 47 (FIG. 1), the pressurized air flows successively into the air capture groove 90 of the annular piston 60 of the operator end stabilizer 52, through the angled entrance passage 91 defined in the annular piston 60 of the operator end stabilizer 52, through the check valve disposed in the internal valve chamber 100 of the annular piston 60 of the operator end stabilizer 52, through the internal valve chamber 100 defined in the annular piston 60 of the operator end stabilizer 52, into the circumferentially extending air pressure plenum 94 defined between annular piston 60 and outer shell 53 of the operator end stabilizer 52, through the three the outer axial conduits 105 defined in the outer shells of the operator end stabilizer 52 and through the three axially extending hollow tubes 75 extending between the first and second stabilizers, 51, 52 and into the circumferentially extending air pressure plenum 94 defined between annular piston 60 and outer shell 53 of the motor end stabilizer 51.

Figure 14A:
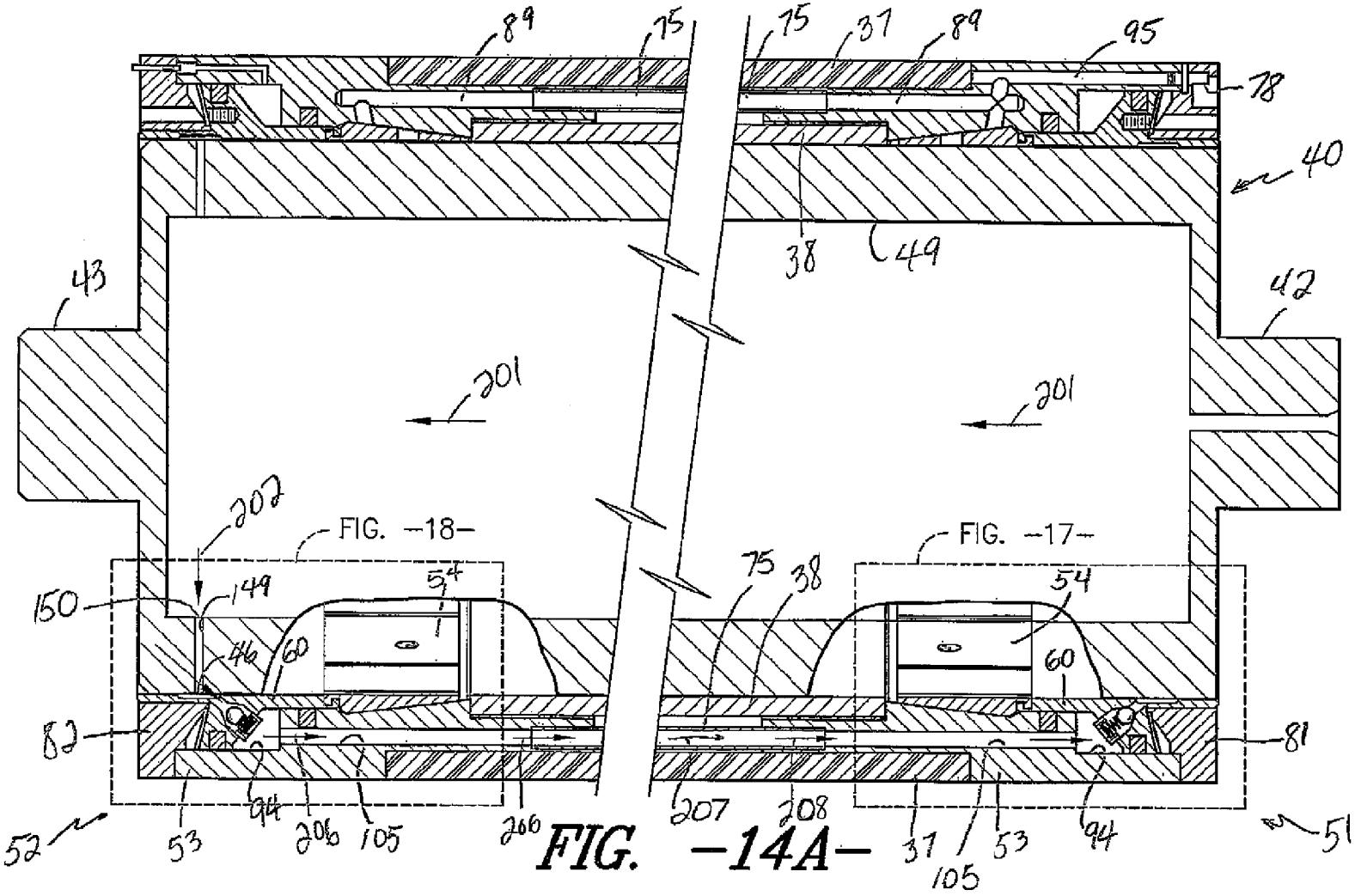
FIG. 14A schematically represents a cross-sectional view (taken along the sight arrows designated 14A-14A in FIG. 6) of an inventive embodiment of a bridge sleeve (broken in the middle) mounted on the mandrel after the pressurized air is introduced into the stabilizers and creates an air cushion between the mandrel and the inner core of the bridge sleeve so that the bridge sleeve can be removed from the mandrel.
Figure 14B:
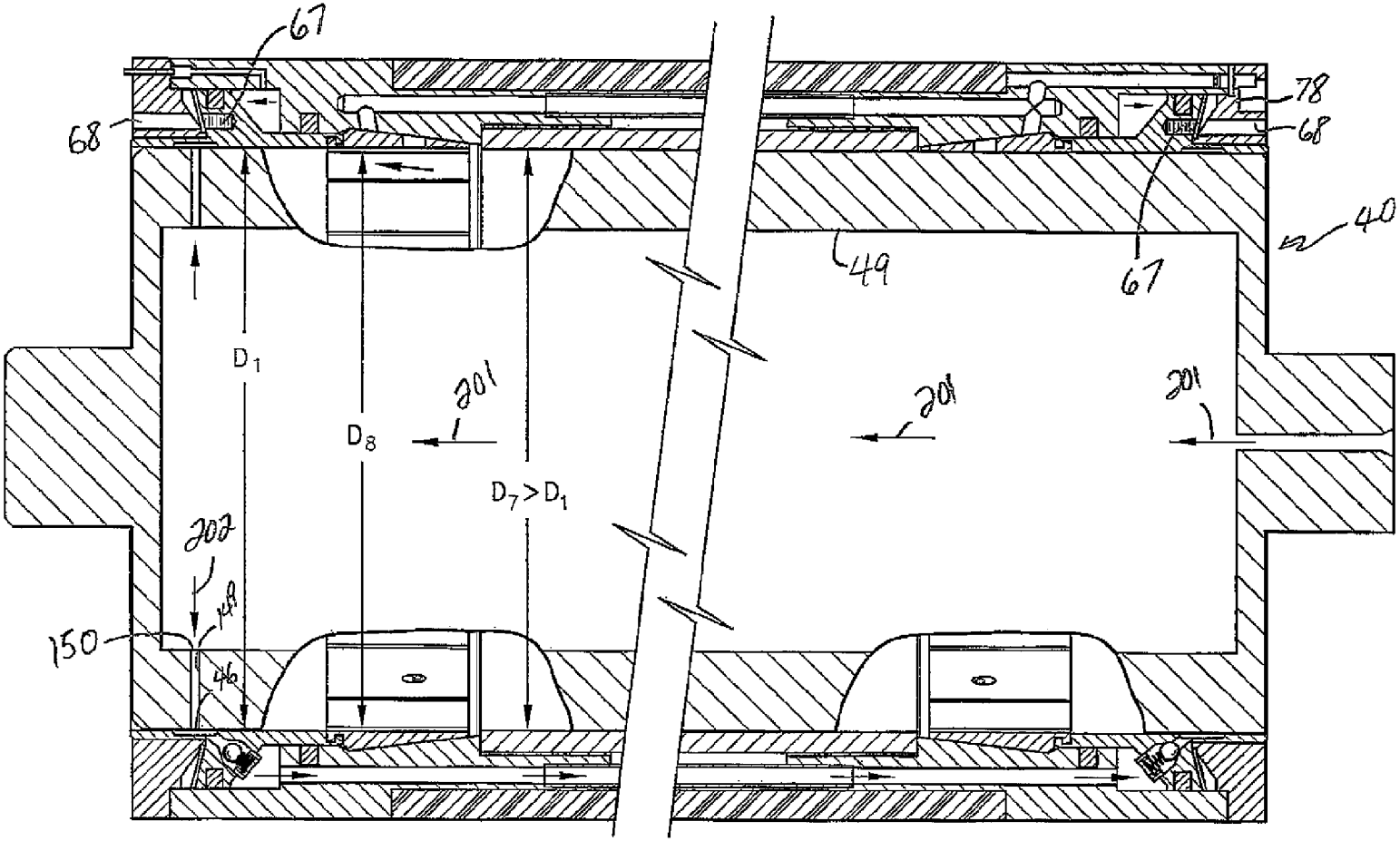
FIG. 14B schematically represents a cross-sectional view (taken along the sight arrows designated 14A-14A in FIG. 6) of an inventive embodiment of a bridge sleeve (broken in the middle) mounted on the mandrel showing various relative diametric dimensions after the pressurized air is introduced into the stabilizers and creates an air cushion between the mandrel and the inner core of the bridge sleeve so that the bridge sleeve can be removed from the mandrel.
Figure 15:
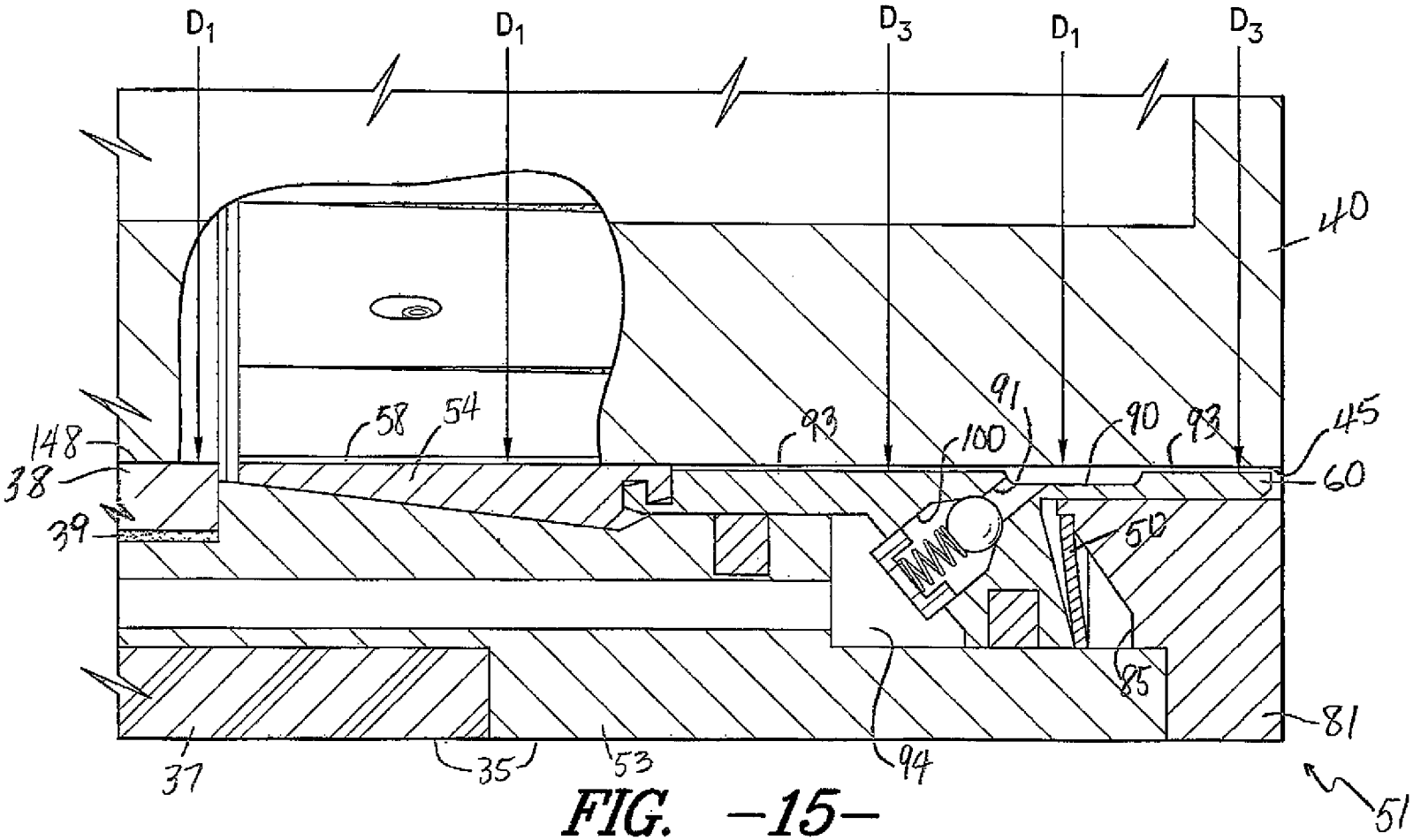
Figure 16:
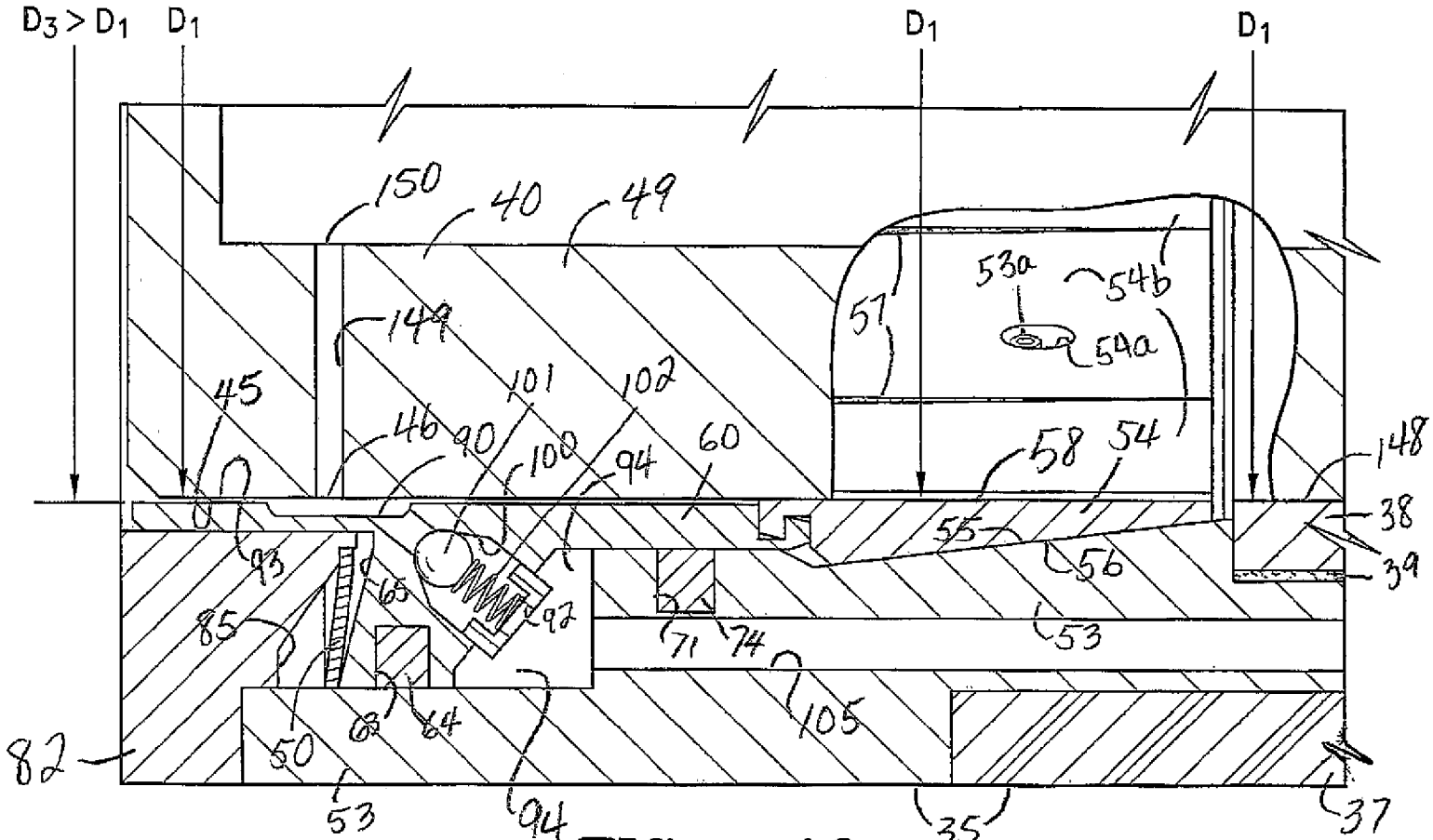

The arrows designated 201 in FIGS. 14A, 14B, 17 and 18 schematically represent the pressurized air traveling through the axially extending central bore 49 of the mandrel 40. The arrows designated 202 in FIGS. 14A, 14B and 18 schematically represent the pressurized air traveling from the axially extending central bore 49 of the operator end of the mandrel 40 and into the radially extending bores 149 via the holes 150 that form the entrances of each of the radial bores 149 of the operator end of the mandrel 40. The arrow designated 203 in FIG. 18 schematically represents the pressurized air traveling through the radially extending bores 149 of the operator end of the mandrel 40 to the holes 46 through the outer surface 45 of the mandrel 40.

As schematically shown in FIG. 18 by the arrow 204, upon exiting the holes 46 through the outer surface 45 of the mandrel 40, the pressurized air fills the air capture groove 90 of the annular piston 60 and passes into the angled entrance passage 91 that leads away from the air capture groove 90. The pressurized air then leaves the entrance passage 91 and pushes past the one way valve to enter the internal valve chamber 100 of the annular piston 60. As schematically shown in FIG. 18 by the arrow 205, the pressurized air leaves the internal valve chamber 100 via the exit opening 92 and passes into the air pressure plenum 94 defined between annular piston 60 and outer shell 53. The pressure sealing rings 64, 74 ensure retention of the pressurized air in the pressurized air circuit of the bridge sleeve 30.

Figure 17:
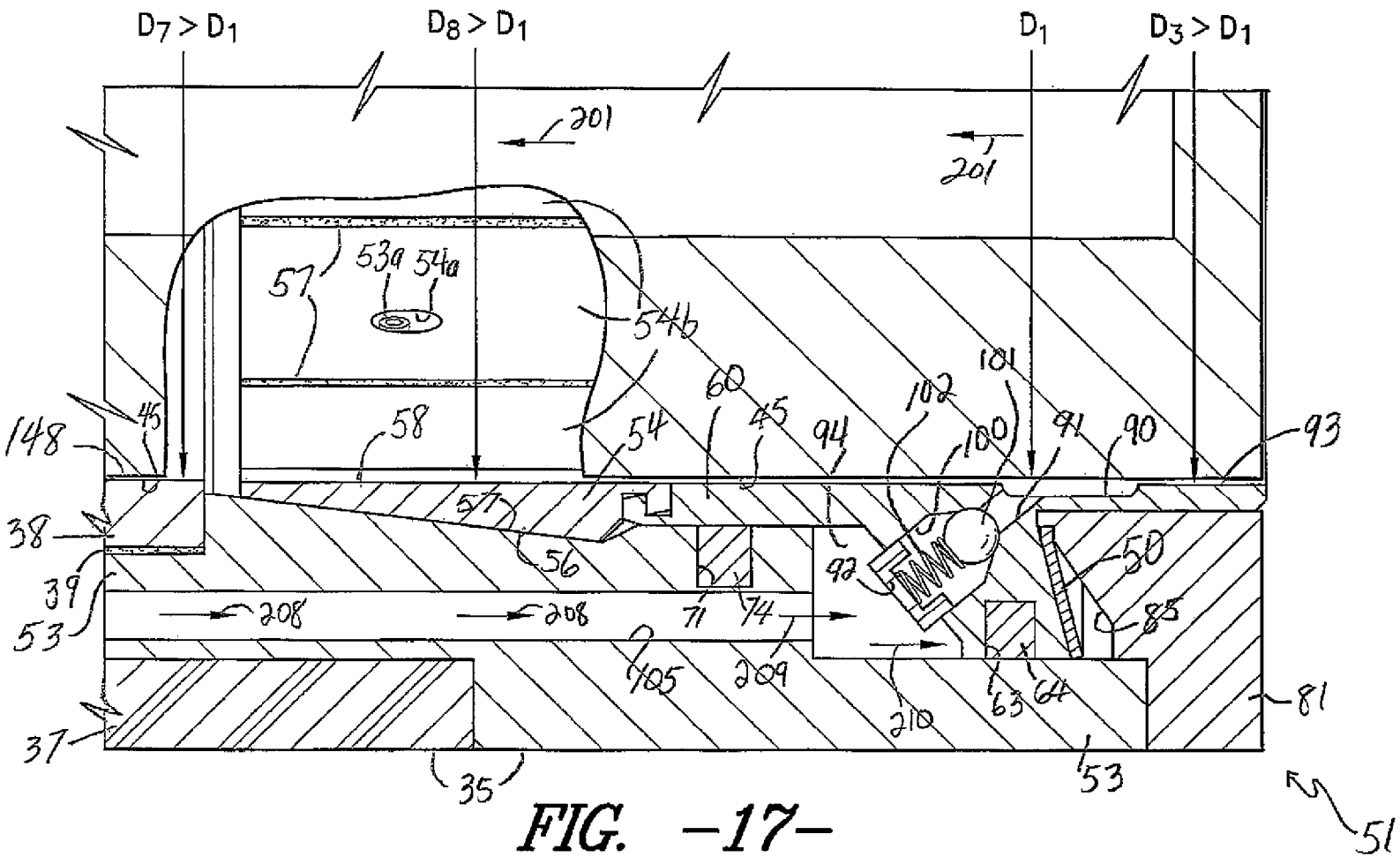
FIG. 17 schematically illustrates an enlarged cross-sectional view of part of the motor end of the embodiment of the bridge sleeve shown in FIG. 14, after the pressurized air is introduced into the stabilizers and develops an air bearing beneath the inner core so that the bridge sleeve can be removed from the mandrel.

As schematically shown in FIGS. 14A and 18 by the arrow designated 206, the pressurized air that fills the air pressure plenum 94 also enters the axial air passage 105 formed in the outer shell 53. As schematically shown in FIG. 14A by the arrow 207, the pressurized air that leaves the axial air passage 105 formed in the outer shell 53 of the operator end stabilizer 52 travels via the axially extending hollow tube 75 to the operator end stabilizer 52. As schematically shown in FIGS. 14A and 17 by the arrows designated 208, the pressurized air that has traveled via the axially extending hollow tube 75 to the motor end stabilizer 51 enters the axial air passage 105 formed in the outer shell 53 of the motor end stabilizer 51. As schematically shown in FIG. 17 by the arrow 209, the pressurized air leaves the axial air passage 105 formed in the outer shell 53 of the motor end stabilizer 51 and enters the air pressure plenum 94 defined between annular piston 60 and the outer shell 53 of the motor end stabilizer 51. However, due to the configuration and orientation of the one-way valve disposed in the internal valve chamber 100 of the annular piston 60 of the motor end stabilizer 51, pressurized air entering the internal valve chamber 100 via the exit opening 92 cannot escape via the angled entrance passage 91 in the annular piston 60 of the motor end stabilizer 51 and so remains in the air pressure plenum 94.

As schematically shown by the arrow designated 205 in FIG. 18 and the arrow designated 210 in FIG. 17, the pressurized air filling the respective air pressure plenums 94 pushes against the tension in the respective springs 50 and axially translates the respective annular pistons 60 toward the respective end cap 81, 82. Because each inner shell 54 is integrally connected to the its respective annular piston 60, movement of the annular pistons 60 toward the respective annular end caps 81, 82 results in commensurate movements of the respective inner shells 54 toward the respective annular end caps 81, 82. Such movements result in the expansion of the diameters of the inner contacting surfaces 58 of the inner shells 54 from the diameter schematically designated D1 in FIG. 13B to the diameter schematically designated D8 in FIG. 14B. The diameter of the inner contacting surfaces 58 of the inner shells 54 schematically designated D1 in FIG. 13B is the same as the diameter of the outer surface 45 of the mandrel 40 schematically designated D1 in FIG. 13B. However, the diameter of the inner contacting surfaces 58 of the inner shells 54 schematically designated D8 in FIG. 14B is larger than the diameter of the outer surface 45 of the mandrel 40 schematically designated D1 in FIG. 14B.

The pressurized air thus can actuate the stabilizers 51, 52 of the bridge sleeve 30 so as to expand their inner contacting surfaces 58 sufficiently to remove their contact with the underlying outer surface 45 of the mandrel 40 and enable the pressurized air to propagate further down the outer surface 45 of the mandrel and expand the inner surface 148 of the inner core 38 of the bridge sleeve 30 sufficiently to slide off of the mandrel 40. As schematically shown in FIG. 18, continued supply of the pressurized air has penetrated beneath the inner surface 148 of the radially expandable cylindrical inner core 38 of the bridge sleeve 30 in the usual manner to provide a cushion of air that expands the diameter (schematically designated D7) of the inner surface 148 of the inner core 38 sufficiently larger than the diameter D1 of the outer surface 45 of the mandrel 40 to enable the bridge sleeve 30 to be slid off of the outer surface 45 of the mandrel 40.

In a bridge sleeve 30 such as the present invention in which some components (e.g., 54, 60) are axially translated with respect to other components (e.g., 53, 81, 82) during each changeover cycle of mounting and dismounting the bridge sleeve 30 with respect to the mandrel 40 of the printing machine, care must be taken to guard against any misalignments that might lead to problems in mounting and dismounting the bridge sleeve 30 to and from the mandrel 40. In accordance with one aspect of the present invention, a mechanism is provided to ensure alignment of the axially shifting components 54, 60 with the axis of rotation 30*a* (FIG. 2) of the bridge sleeve 30 and the mandrel 40 at each changeover cycle of the bridge sleeve 30. As embodied herein and shown in FIGS. 13D, 20A and 20B for example, each of the annular pistons 60 and its respective end cap 81, 82 is provided with a self-alignment surface 60*a*, 60*b* that is disposed in opposition to each other. Each self-alignment surface 60*a*, 60*b* is an annular-shaped surface that extends circumferentially around the respective annular pistons 60 and its respective end cap 81, 82. Each self-alignment surface 60*a*, 60*b* is configured so that it is normal to the axis of rotation of the respective annular piston 60 and end cap 81 or 82. The axis of rotation of each annular piston 60 and each end cap 81, 82 coincides with the axis of rotation 30*a* (FIG. 2) of the bridge sleeve 30 when mounted on the mandrel 40 of the printing machine. When the pressurized air is introduced into the internal valve chamber 100 (e.g., FIG. 13D) of the annular piston 60, the air pressure will move the annular piston 60 against the biasing force of the spring 50 and toward the respective end cap 81 or 82 until the self-centering surface 60*a* of the annular piston 60 butts against the opposing self-centering surface 60*b* of the respective end cap 81 or 82. When these two self-centering surfaces 60*a*, 60*b* touch, because each of them is normal to the axis of rotation of the respective annular piston 60 and end cap 81 or 82, alignment of the axis of rotation of the annular piston 60 with the axis of rotation 30*a* (FIG. 2) of the bridge sleeve 30 and the mandrel 40 is ensured. Moreover, this self-correcting realignment of the annular piston 60 also effects realignment of the connected inner shell 54 during each cycle of pressurizing the stabilizers 51, 52 of the bridge sleeve 30.

As shown in FIGS. 3, 5, 6, 7A, 8B and 14B for example, the annular piston 60 in each of the stabilizers 51, 52 desirably includes a threaded hole 67 that extends axially into the annular piston 60 from the outwardly facing side 65 of the annular piston 60 but terminates before passing through the opposite inwardly facing side 66 of the annular piston 60. As schematically shown in FIGS. 3, 4 and 8B for example, each of the respective annular end caps 81, 82 is provided with an axially extending through hole 68 that is aligned concentrically with the threaded hole 67 in the respective adjacent annular piston 60. Desirably, as shown in FIGS. 5 and 6 for example, three equally spaced apart through holes 68 are provided, one for each of the three equally spaced apart threaded holes 67 that are provided in each annular piston 60. As shown in FIGS. 5 and 6 for example, the three through holes 68 desirably are located nearer the smaller diameter edge 77 of the annular end caps 81, 82. Thus, each threaded hole 67 in each annular piston 60 is accessible by the operator from outside the bridge sleeve 30 without disassembling the bridge sleeve 30. Each threaded hole 67 in each annular piston 60 can receive the complementarily threaded end of a tool (not shown) that the operator can screw into the threaded hole 67 and then manually pull the annular piston 60 toward the operator to loosen the piston 60 and its associated inner shell 54 in the event that they should become stuck due to the inability of the pressurized air to effect the desired expansion of the diameter of the inner contacting surface 58 of the inner shell of the stabilizer 52 for example.

Figure 19:
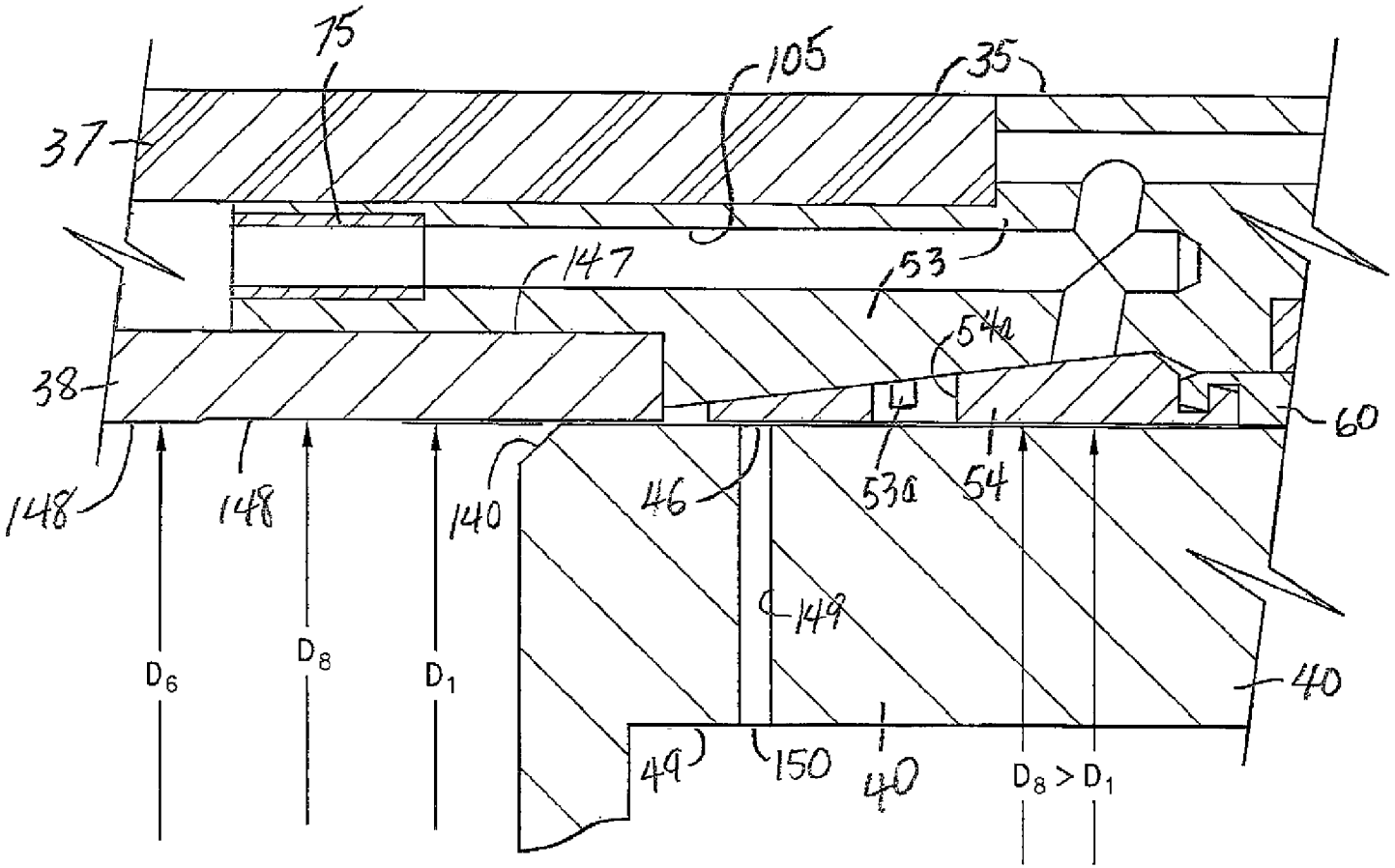
FIG. 19 schematically illustrates an enlarged cross-sectional view after the pressurized air is introduced into the stabilizers but before an air bearing is created between the mandrel and the inner core of the bridge sleeve and showing various relative diametric dimensions of a part of an embodiment of the motor end of a bridge sleeve of the present invention that does not have a compressible layer between the inner core and the outer shell of the stabilizers.
Figure 20A:
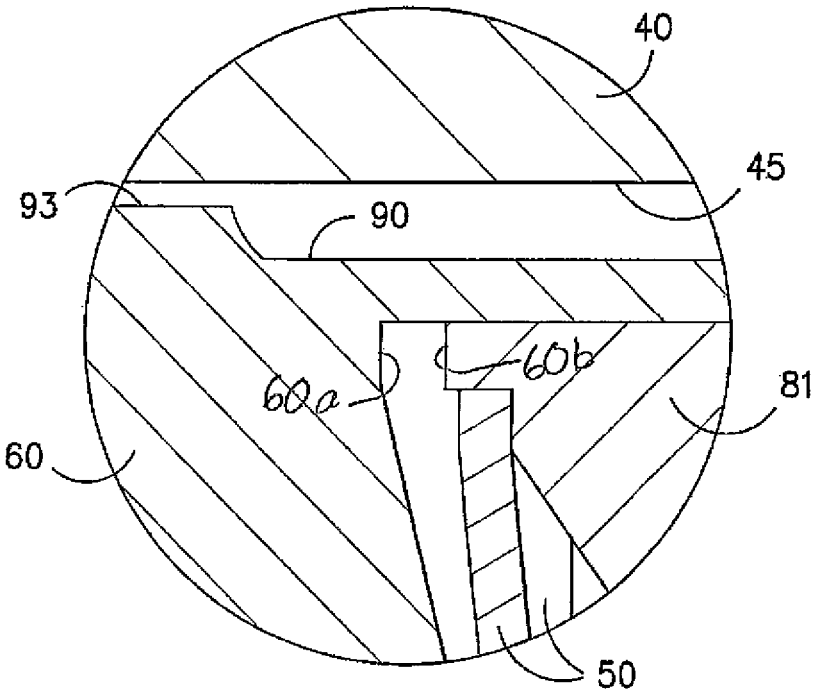
FIG. 20A schematically illustrates before the pressurized air is introduced into the stabilizers, an enlarged cross-sectional view of part of an embodiment of the motor end of a bridge sleeve of the present invention depicted in the balloon shown in FIG. 13D to schematically illustrate the self-centering of the annular piston of the stabilizers.

In alternative embodiments of the bridge sleeve 38 of the present invention, it is possible to eliminate the compressible layer 39 disposed between the outer surface 147 of the inner core 38 and the outer shell 53 such as shown schematically in FIG. 18 for example. Such an exemplary embodiment is schematically illustrated in FIG. 19. Each of the outer extremities on each opposite end of the inner core 38 is defined by a diameter D8 that is larger than the diameter D1 of the outer surface 45 of the mandrel 40. The rest of the inner core 38 is the main portion of the inner core 38 extending between the two extremities and has an inner surface 148 that is defined by a diameter D6 that is smaller than the diameter D1 of the outer surface 45 of the mandrel 40 in the absence of the application of pressurized air between the outer surface 45 of the mandrel and the inner surface 148 of the inner core 38. The axial length of the extremity defined by the relatively enlarged diameter D8 at each opposite end of the inner core 38 is determined so that the holes 46 through the outer surface 45 of the mandrel 40 that expel pressurized air will be disposed opposite this portion of the inner surface of the inner core 38 having the relatively enlarged diameter D8 before the leading edge 140 of the mandrel 40 reaches the main portion of the inner core 38 with the inner surface defined by the diameter D6. In this way, the empty space between the rigid outermost layer 37 and the inner core 38 allows the pressurized air from the holes 46 through the outer surface 45 of the mandrel 40 to expand the diameter of the inner surface 148 of the inner core 38 sufficiently to accommodate passage of the outer diameter D1 of the mandrel 40. But when the pressurized air is stopped, then the diameter of the inner surface 148 of the inner core 38 retracts to a diameter D6 that is smaller than the diameter D1 of the outer surface 45 of the mandrel 40.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A bridge sleeve on which a print sleeve can be air-mounted, the bridge sleeved defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bride sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a first annular piston that is disposed in the first stabilizer and having a first end connected the first inner shell, the first annular piston being moveable in the axial direction with respect to the first outer shell;

g. a first annular end cap connected to the first outer shell;

h. a first spring disposed in the first stabilizer in tension between the first annular end cap and the first annular piston; and i. wherein the diameter of the respective inner cylindrical contacting surface changes as the respective inner shell moves axially relative to the respective rigid outer shell; and j. wherein the diameter of the inner cylindrical contacting surface of the first inner shell changes proportional to the tension in the first spring.

2. The bridge sleeve as in claim 1, further comprising:

a. wherein the first annular end cap is connected to the outer shell of the first stabilizer and defines a first self-alignment annular surface that is configured so that it is normal to the axis of rotation of the bridge sleeve; and b. wherein the first annular piston defines a second self-alignment annular surface that is configured so that it is normal to the axis of rotation of the first annular piston and disposed opposite the first self-alignment annular surface of the first annular end cap.

3. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a first annular piston that is disposed in the first stabilizer and having a first end connected the first inner shell, the first annular piston being moveable in the axial direction with respect to the first outer shell;

g. a first groove configured in an exterior surface of the first annular piston;

h. a first pressure sealing ring disposed in this first groove;

i. a second groove configured in an interior surface of the first outer shell; and j. a second pressure sealing ring disposed in this second groove; and k. wherein the diameter of the respective inner cylindrical contacting surface changes as the respective inner shell moves axially relative to the respective rigid outer shell.

4. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. wherein the diameter of the respective inner cylindrical contacting surface changes as the respective inner shell moves axially relative to the respective rigid outer shell; and wherein the inner shell of the first stabilizer defines an oblong opening and the outer shell of the first stabilizer includes a set screw projecting into the oblong opening of the inner shell of the first stabilizer and acting as a guide for the axial movement of the inner shell of the first stabilizer relative to the outer shell of the first stabilizer.

5. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a first annular end cap connected to the outer shell of the first stabilizer;

g. a first annular piston that is disposed in the first stabilizer and having a first end connected to the inner shell of the first stabilizer and being moveable in the axial direction with respect to the outer shell of the first stabilizer, the first annular piston defining a first internal valve chamber;

h. a first spring disposed in the first stabilizer in tension between the first annular end cap and the first annular piston;

i. a first air pressure plenum in fluid communication with the first internal valve chamber and defined between the first annular piston and the outer shell of the first stabilizer, the first air pressure plenum being configured to change its volume depending on the axial movement of the first annular piston with respect to the outer shell of the first stabilizer;

j. a first air-flow check valve disposed in the first internal valve chamber of the first annular piston and configured to allow air into the first internal valve chamber and the first air pressure plenum while preventing escape of air from the first air pressure plenum; and k. wherein the diameter of the respective inner cylindrical contacting surface changes as the respective inner shell moves axially relative to the respective rigid outer shell; and l. wherein the diameter of the respective inner cylindrical contacting surface of the first inner shell changes proportional to the volume defined by the first air pressure plenum.

6. The bridge sleeve as in claim 5, further comprising:

a. a first self-alignment annular surface that defined on the first annular end cap and configured so that it is normal to the axis of rotation of the bridge sleeve;

b. a second self-alignment annular surface that is defined on the first annular piston and disposed opposite the first self-alignment annular surface of the first annular end cap, the second self-alignment annular surface is configured so that it is normal to the axis of rotation of the first annular piston; and c. wherein pressurized air entering the first internal valve chamber of the first annular piston will move the first annular piston against the biasing force of the spring and toward the first annular end cap until the second self-centering surface of the first annular piston butts against the opposing first self-centering surface of the first annular end cap and effects a centering of the first annular piston around the rotational axis of the bridge sleeve.

7. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a pressurized air circuit extending axially between the stabilizers and including at least one air-flow check valve; and g. wherein the diameter of the respective inner cylindrical contacting surface of each respective inner shell changes as the respective inner shell moves axially relative to the respective rigid outer shell and according to the magnitude of the pressure in the pressurized air circuit.

8. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a first spring disposed in the first stabilizer;

g. a second spring disposed in the second stabilizer;

h. a pressurized air circuit extending axially between the stabilizers and including at least one air-flow check valve; and i. wherein the diameter of the respective inner cylindrical contacting surface changes as the respective inner shell moves axially relative to the respective rigid outer shell; and j. wherein the diameter of the respective inner cylindrical contacting surface of each respective inner shell changes according to the magnitude of the compression of the respective spring; and k. wherein the degree of compression of each spring varies according to the magnitude of the pressure in the pressurized air circuit.

9. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface;

f. a first spring disposed in the first stabilizer; and g. a second spring disposed in the second stabilizer; and h. wherein the diameter of the respective inner cylindrical contacting surface changes as the respective inner shell moves axially relative to the respective rigid outer shell;

i. wherein the diameter of the respective inner cylindrical contacting surface of each respective inner shell changes according to the magnitude of the compression of the respective spring; and j. wherein at least one of the first and second springs is a flat ring spring.

10. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface;

f. a first spring disposed in the first stabilizer;

g. a second spring disposed in the second stabilizer;

h. a first annular end cap connected to the first outer shell; and i. a first annular piston that is disposed in the first stabilizer and having a first end connected to the inner shell of the first stabilizer and being moveable in the axial direction with respect to the first outer shell of the first stabilizer, wherein the first spring is disposed and under tension between the first annular end cap and the first annular piston of the first stabilizer; and j. wherein the diameter of the respective inner cylindrical contacting surface changes as the respective inner shell moves axially relative to the respective rigid outer shell; and k. wherein the diameter of the respective inner cylindrical contacting surface of each respective inner shell changes according to the magnitude of the compression of the respective spring.

11. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a first annular end cap defining a plurality of bores extending axially therethrough, the first annular end cap being disposed at an end of the first stabilizer opposite an end of the first stabilizer carrying the first end of the incompressible layer; and g. wherein the outer shell of the first stabilizer defines a plurality of threaded bores extending axially therein, each of said threaded bores being in alignment with a different respective bore defined through the first annular end cap and receiving therein a separate respective threaded bolt extending through a separate one of the bores defined through the first annular end cap; and h. wherein the diameter of the respective inner cylindrical contacting surface changes as the respective inner shell moves axially relative to the respective rigid outer shell.

12. A bridge sleeve on which a print sleeve can be air-mounted, the bridge sleeve defining a through bore that has an axis of rotation and is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bride sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface; and f. a first annular end cap defining at least one bore extending axially therethrough, the first annular end cap being disposed at an end of the first stabilizer; and g. a first annular piston that is disposed in the first stabilizer and having a first end connected to the inner shell of the first stabilizer and being moveable in the axial direction with respect to the outer shell of the first stabilizer, wherein the first annular piston defines at least one threaded bore extending axially therein and disposed in concentric alignment with the at least one bore extending axially through the first annular end cap; and g. wherein the diameter of the respective inner cylindrical contacting surface changes as the respective inner shell moves axially relative to the respective rigid outer shell.

13. A bridge sleeve that is air-mountable on the exterior surface of a mandrel of a printing machine and on which bridge sleeve a print sleeve can be air-mounted, the bridge sleeve comprising:

a. an incompressible outer layer defining a first end and a second end displaced axially from the first end and defining an outer surface extending axially between the two ends, the outer surface configured for contacting the inner surface of a print sleeve;

b. a resiliently, diametrically expandable and contractable inner core defining a first end and a second end displaced axially from the first end and defining a through bore extending between the first end and the second end, each of the first end and second end being open;

c. a first, rigid stabilizer at one end of the bridge sleeve and connected to the first end of the inner core and the first end of the incompressible outer layer;

d. a second, rigid stabilizer axially displaced from the first stabilizer and connected to the second end of the inner core and the second end of the incompressible outer layer;

e. each stabilizer includes a rigid outer shell that has an axially extending inner cavity that is partially defined by a rigid inner surface with a section defining a conical surface;

f. each stabilizer includes a respective inner shell that defines an inner cylindrical contacting surface and is axially, moveably received within the respective axially extending inner cavity of the respective rigid outer shell so as to change the diameter of the inner cylindrical contacting surface of the inner shell; and g. wherein when the bridge sleeve is non-rotatably mounted to the mandrel, the axial position of the respective inner shell relative to the respective rigid outer shell is disposed to ensure rigid concentric contact from the exterior surface of the rotary mandrel successively through the inner core, the respective inner shell, the rigid outer shell and the incompressible outer layer.

* * * * *